US007444765B2

(12) United States Patent
Hay et al.

(10) Patent No.: US 7,444,765 B2
(45) Date of Patent: Nov. 4, 2008

(54) FOOT GUIDED SHOE SOLE AND FOOTBED

(75) Inventors: Gordon Graham Hay, Marblehead, MA (US); Keith M. Orr, Boston, MA (US); Derek Carroll, Marblehead, MA (US)

(73) Assignee: Bivab, LLC, Marblehead, MA (US)

( * ) Notice: Subject to any disclaimer, the term of this patent is extended or adjusted under 35 U.S.C. 154(b) by 155 days.

(21) Appl. No.: 11/292,974

(22) Filed: Dec. 2, 2005

(65) Prior Publication Data

US 2006/0080862 A1 Apr. 20, 2006

Related U.S. Application Data

(63) Continuation-in-part of application No. 10/246,176, filed on Sep. 18, 2002.

(60) Provisional application No. 60/323,298, filed on Sep. 18, 2001.

(30) Foreign Application Priority Data

Feb. 21, 2001 (IT) ..... MI2001A0351

(51) Int. Cl.
*A43B 13/00* (2006.01)

(52) U.S. Cl. ..... 36/25 R; 36/30 R; 36/31; 36/142

(58) Field of Classification Search ..... 36/43, 36/44, 35 R, 37, 25 R, 30 R, 31, 142–144
See application file for complete search history.

(56) References Cited

U.S. PATENT DOCUMENTS

| | | | |
|---|---|---|---|
| 1,061,353 | A | 5/1913 | Block |
| 1,375,340 | A | 4/1921 | Wilms |
| 1,437,991 | A | 12/1922 | Northrop |
| 1,907,995 | A | 5/1933 | Nickerson |
| 2,064,507 | A | 12/1936 | Sant La Porte Van |
| 2,311,925 | A | 2/1943 | Boos |
| 2,433,329 | A | 12/1947 | Adler |
| 2,710,461 | A | 5/1955 | Hack |
| 4,120,102 | A | 10/1978 | Kenigson |

(Continued)

FOREIGN PATENT DOCUMENTS

| | | | |
|---|---|---|---|
| GB | 2 113 072 | A | 8/1983 |

(Continued)

*Primary Examiner*—Marie Patterson
(74) *Attorney, Agent, or Firm*—Davis Bujold & Daniels, P.L.L.C.

(57) ABSTRACT

A footwear sole structure for dynamically directing interacting forces between a user's foot and the footwear during a stride, including an inner sole located adjacent the user's foot, a mid-sole located between the inner sole and the footwear, and a rib ribbon force transfer structure located between the inner sole and the mid-sole wherein the rib ribbon includes a plurality of ribs spaced along and transversely to a spine axis and attached to a longitudinally extending spine. The rib ribbon resists flexing about an axis parallel to the spine axis and allows a relatively greater degree of flexing about an axis transverse to the spine axis and the rib ribbon is located along a path between the inner and mid-soles to dynamically direct the interacting forces between a user's foot and the footwear as the user's weight shifts from a heel to a toe position during a stride.

20 Claims, 29 Drawing Sheets

U.S. PATENT DOCUMENTS

| | | | |
|---|---|---|---|
| 4,268,980 | A | 5/1981 | Gudas |
| 4,307,521 | A | 12/1981 | Inohara et al. |
| 4,364,189 | A | 12/1982 | Bates |
| 4,435,910 | A | 3/1984 | Marc |
| 4,506,460 | A | 3/1985 | Rudy |
| 4,510,700 | A | 4/1985 | Brown |
| 4,615,126 | A | 10/1986 | Mathews |
| 4,616,431 | A | 10/1986 | Dassler |
| 4,619,056 | A | 10/1986 | Lin et al. |
| 4,776,109 | A | 10/1988 | Sacre |
| 4,800,657 | A | 1/1989 | Brown |
| 4,843,741 | A | 7/1989 | Yung-Mao |
| 4,879,821 | A | 11/1989 | Graham et al. |
| 4,908,962 | A | 3/1990 | Yung-Mao |
| 5,014,706 | A | 5/1991 | Philipp |
| 5,297,349 | A | 3/1994 | Kilgore |
| 5,311,680 | A | 5/1994 | Comparetto |
| 5,400,528 | A | 3/1995 | Skinner et al. |
| 5,493,791 | A | 2/1996 | Kramer |
| 5,647,145 | A | 7/1997 | Russell et al. |
| 5,669,162 | A | 9/1997 | Dyer |
| 5,786,057 | A | 7/1998 | Lyden et al. |
| 5,937,544 | A | 8/1999 | Russell |
| 5,964,046 | A | 10/1999 | Brooks |
| 6,065,230 | A | 5/2000 | James |
| 6,092,311 | A | 7/2000 | MacNamara |
| 6,131,311 | A | 10/2000 | Brown et al. |
| 6,199,302 | B1 | 3/2001 | Kayano |
| 6,199,303 | B1 | 3/2001 | Luthi et al. |
| 6,665,956 | B2 | 12/2003 | Hay |

FOREIGN PATENT DOCUMENTS

| | | |
|---|---|---|
| JP | 5-309001 | 11/1993 |

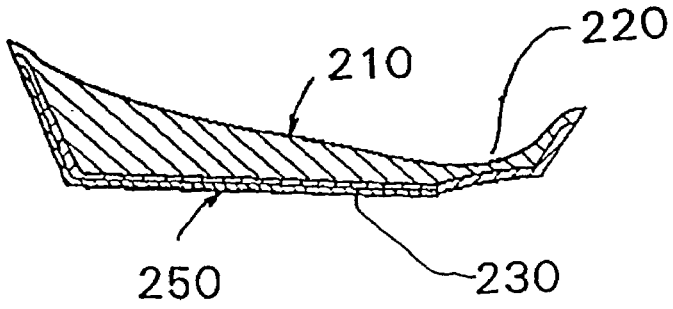
Fig. 12
Fig. 13
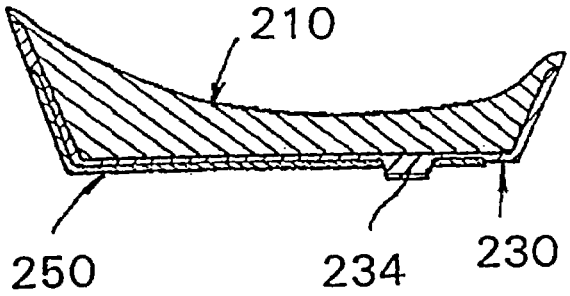
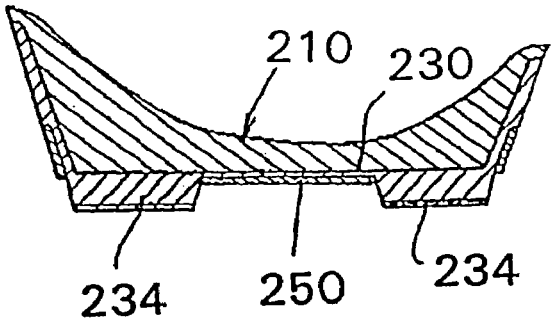
Fig. 14
Fig. 15
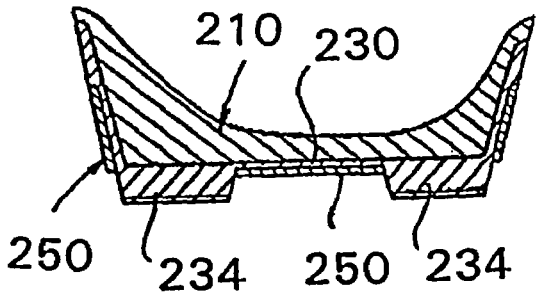

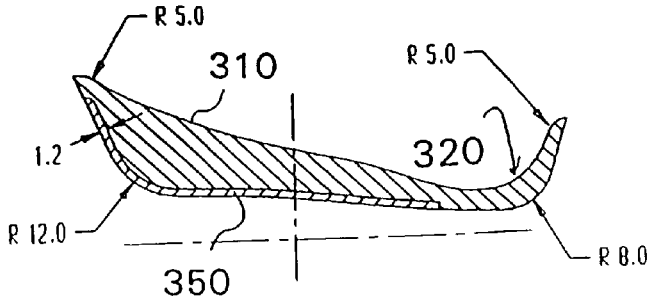
Fig. 27
Fig. 28
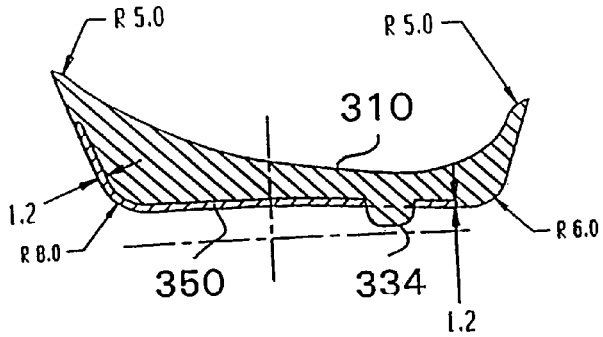
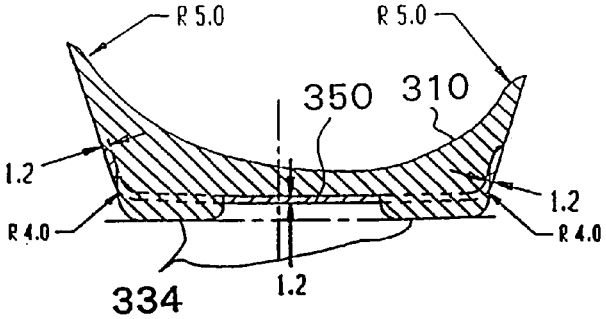
Fig. 29
Fig. 30
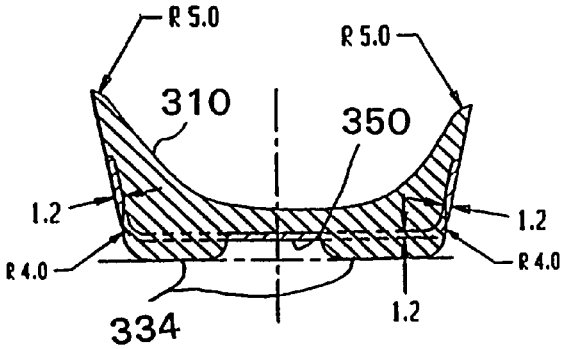

Fig. 52
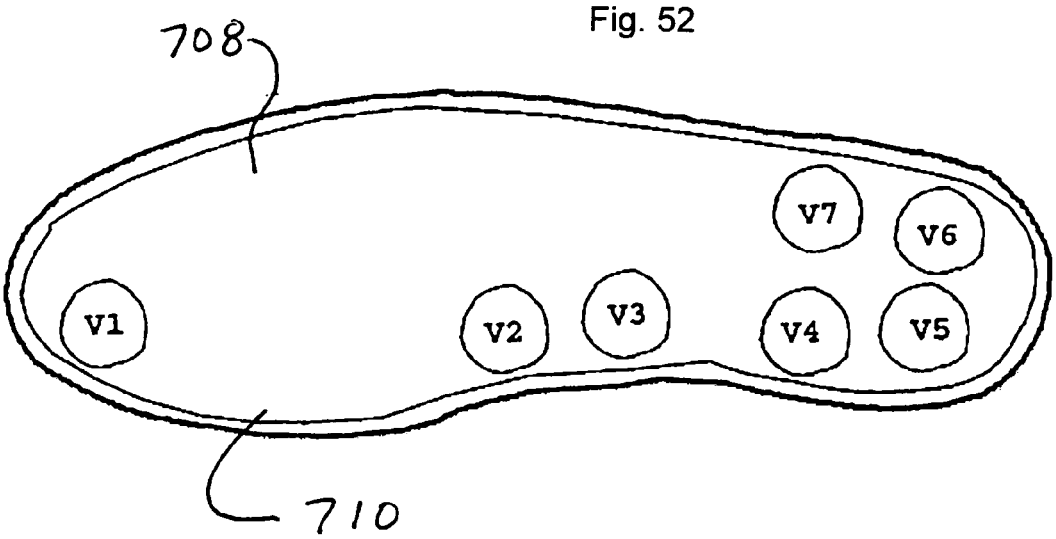
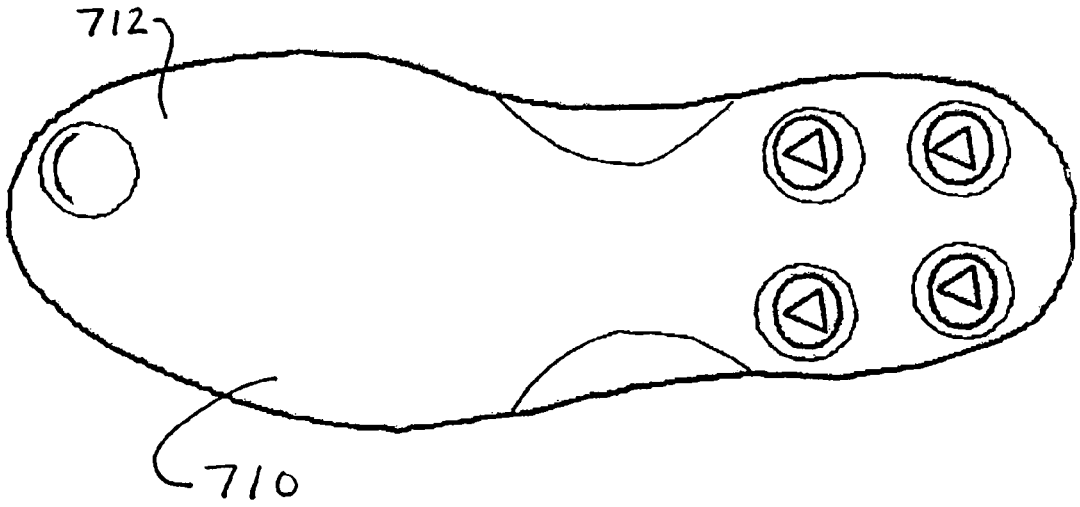
Fig. 51

FOOT GUIDED SHOE SOLE AND FOOTBED

CROSS REFERENCES TO RELATED APPLICATIONS

The present application is a continuation in part of and claims benefit of co-pending U.S. patent application Ser. No. 10/246,176 filed Sep. 18, 2002 which in turn claims benefit of parent U.S. patent application Ser. No. 10/156,577 filed May 24, 2002, which claims benefit of parent PCT Patent Application Ser. No. PCT/US02/05709 filed Feb. 20, 2002, U.S. Provisional Patent Application Ser. No. 60/323,298 filed Sep. 18, 2001, which claims benefit of Italian Patent Application Serial No. MT2001 T000351 filed Feb. 21, 2001.

FIELD OF THE INVENTION

This invention relates to shoe soles and, more specifically, to an inner shoe sole that is structured to react to movement by the wear's foot.

BACKGROUND OF THE INVENTION

Shoe soles are well known in the prior art. Modern shoe soles include many layers, e.g., an outer sole, an middle sole and an inner sole. Typically, there is a rubber outer layer that is structured to contact and engage the ground. This layer has a bottom face that includes a tread or a plurality of protrusions. The rubber outer layer has an upper face that contacts an inner layer. The inner layer typically includes one or more layers of padding. The inner layer may be shaped, e.g., have an arch support. The inner layer, however, is not structured to react to movement occurring within the foot and be guided by the foot during walking.

The human foot is a complex machine of bone linked by a matrix of ligaments and tendons. As a person walks, the foot performs complex actions to stabilize the body and move the body in the desired direction. For example, a runner's bare or naked foot structure naturally adjusts or conforms its shape to provide balance for the body on the soft beach to the inclined variables of the terrain. The internal structure moves its complex matrix and adjusts its shape to work in opposing planes in motion. The moving structure alters the shape of multiple arches. This changes multiple structural functions that suspend, lock, and lever toe extensions along transverse, sagittal and frontal planes. However, the ability of the structure to move along multiple planes is limited and altered by man-made footwear. Much of the natural movement is lost do to the opposing shoe structures.

Prior art soles are not structured to react to the above noted foot motions. That is, the foot will perform such motions which result in the foot moving within the shoe, but not affecting either the inner or outer layer of the sole. Thus, while the foot is in the air, the motions of the foot are, essentially, lost. While the foot is in contact with the ground, the foot is forced to react to the non-responsive sole. That is, conventional shoe soles guide the foot away from the natural function of the foot.

There is, therefore, a need for a sole assembly that is structured to react to and be responsive to the foot. That is, there is a need for a shoe sole that is guided by the foot instead of the foot being guided by the sole.

There is a further need for a sole assembly that has a outer sole assembly and a replaceable reactive upper sole assembly, having a variety different configurations, to suit the needs of the specific wear's foot.

SUMMARY OF THE INVENTION

The present invention is directed to a footwear sole structure for dynamically directing interacting forces between a user's foot and the footwear during a stride, including an inner sole located adjacent the user's foot, a mid-sole located between the inner sole and the footwear, and a rib ribbon force transfer structure located between the inner sole and the mid-sole wherein the rib ribbon includes a plurality of ribs spaced along and transversely to a spine axis and attached to a longitudinally extending spine. The rib ribbon resists flexing about an axis parallel to the spine axis and allows a relatively greater degree of flexing about an axis transverse to the spine axis and the rib ribbon is located along a path between the inner and mid-soles to dynamically direct the interacting forces between a user's foot and the footwear as the user's weight shifts from a heel to a toe position during a stride.

In a presently preferred embodiment, the rib ribbon is located between the inner and mid-soles along a crossed ribbon loop path and includes a heel loop segment surrounding a heel section of a foot, an inside transverse segment extending from the inner forward end of the heel loop segment on an inner side of the foot and crossing under an arch of the foot in approximately an arch region and curving into a curve of an outside of the foot at approximately a forward side of the arch region, and an outside transverse segment extending from the forward end of the heel loop segment on an outer side of the foot and crossing under the arch of the foot in approximately the arch region and curving into a curve of an inner side of the foot at approximately the forward side of the arch region. The force direction characteristic of each region of the inner and mid-soles is thereby determined by the flexing characteristics of the force direction structure located in the region.

In the present embodiment of the invention as stated above, the ribs of a portion of the inner transverse segment are generally eliminated in the arch region where the outer transverse segment crosses the inner transverse segment so that the flexing characteristic of the outer transverse segment predominate in the arch region.

In this embodiment, therefore, the heel loop segment restrains the heel of the user's foot against at least one of a transverse motion and a rotational motion and the outer transverse segment in the region of the arch directs a transfer of the user's weight from the outer side of the foot and across the arch to the inner side of the foot at a ball and toe region of the foot.

In addition, and in a presently preferred embodiment, a first half of the heel loop segment and the inside transverse segment are located on an upper surface of the mid-sole and that a second half of the heel loop segment and the outside transverse loop segment are located on a lower surface of the inner sole.

The term "downward", as used in this application, means to move generally in direction perpendicularly toward an outer most surface of an outer sole and the term "upward", as used in this application, means to move generally in direction perpendicularly away from the outer most surface of the outer sole.

BRIEF DESCRIPTION OF THE DRAWINGS

A full understanding of the invention can be gained from the following description of the preferred embodiments when read in conjunction with the accompanying drawings in which:

FIG. 12 is diagrammatic cross-sectional view along section line 12-12 of FIG. 2;

FIG. 13 is diagrammatic cross-sectional view along section line 13-13 of FIG. 2;

FIG. 14 is diagrammatic cross-sectional view along section line 14-14 of FIG. 2;

FIG. 15 is diagrammatic cross-sectional view along section line 15-15 of FIG. 2;

FIG. 27 is diagrammatic cross-sectional view along section line 27-27 of FIG. 16;

FIG. 28 is diagrammatic cross-sectional view along section line 28-28 of FIG. 16;

FIG. 29 is diagrammatic cross-sectional view along section line 29-29 of FIG. 16;

FIG. 30 is diagrammatic cross-sectional view along section line 30-30 of FIG. 16;

FIG. 51 is a diagrammatic bottom view of exterior sole equipped with a plurality of removable cleats;

FIG. 52 is a diagrammatic top plan view of the exterior sole of FIG. 51;

DETAILED DESCRIPTION OF THE INVENTION

Figure 1:
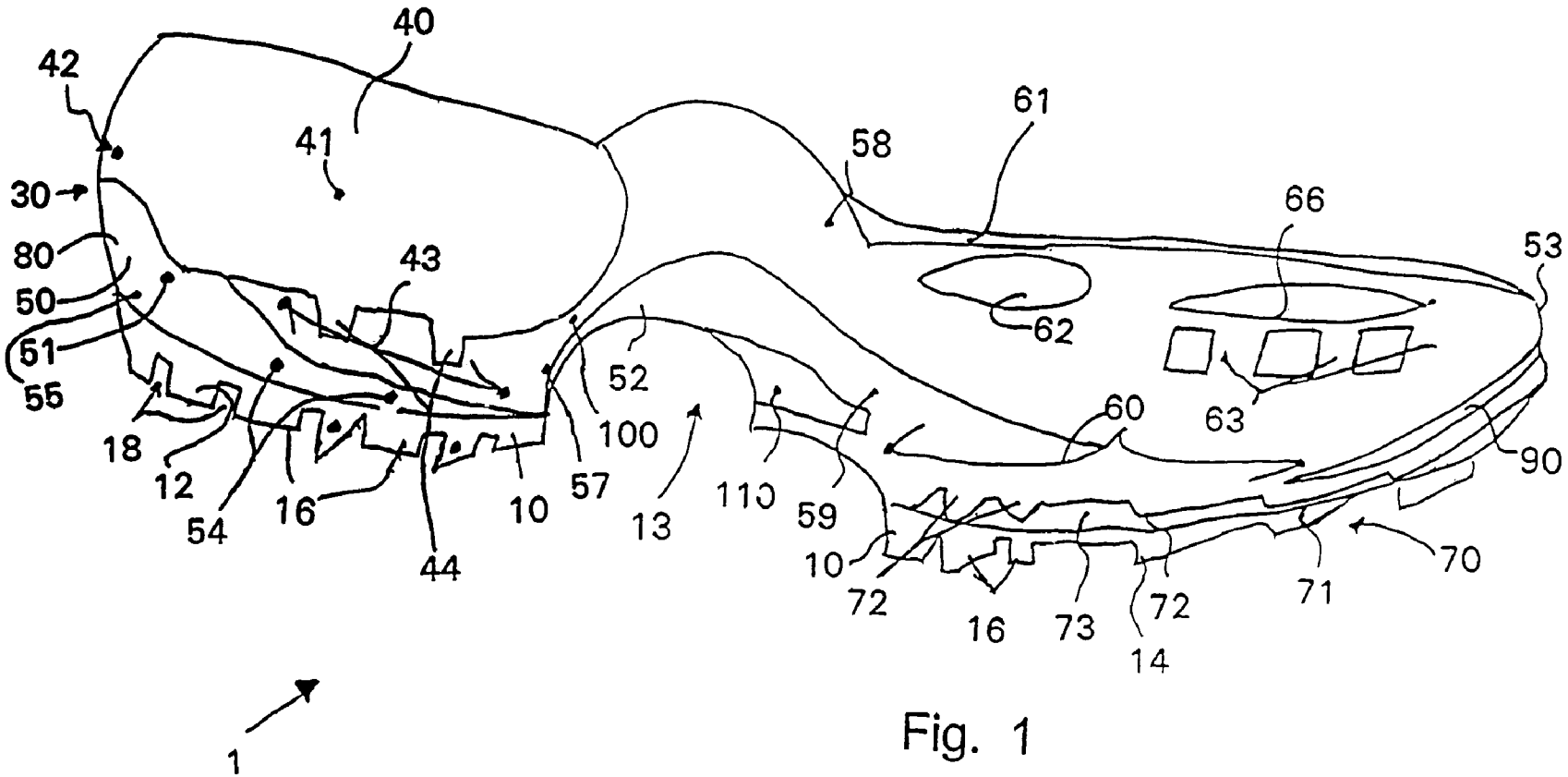
FIG. 1 is a diagrammatic perspective view showing the various components comprising a first embodiment of the innersole assembly according to the present invention.

As shown in FIG. 1, a shoe sole assembly 1 includes a outer sole assembly 10 and a reactive upper sole assembly 30. The elongate side of the sole 1 that is structured to contact a user's big toe is referred to as the "inner" side of the sole 1, and the elongate side of the sole that is structured to contact the user's little toe is referred to as the "outer" side. As shown in FIG. 1, the outer sole assembly 10 is divided into a heel portion 12 and a forward portion 14. An arch portion 13 is located between the heel portion 12 and the forward portion 14. The outer sole assembly 10 may be a continuous member from the heel portion 12 to the front portion 14. As is well known in the art, the outer sole assembly 10 is typically manufactured from a flexible material, or combinations of materials, such as rubber, EVA, nylon, TPU, TPR, or urethane. The bottom ground engaging surface of the outer sole assembly 10 includes a plurality of protrusions 16. The protrusions 16 are divided or separated by grooves 18, thus forming a tread, as is well known in this art. The protrusions may be solid or hollow depending upon the particular application at hand.

A bottom surface of the reactive upper sole 30 is coupled to a top surface of the outer sole 10. The reactive upper sole 30 is structured to react to movements by and within the wear's foot, as will be described in further detail below. The reactive upper sole 30 includes a first frame 40, a second frame 50, and a third frame 70. The first frame 40 and the third frame 70 may be joined for lever functions or linked by a resilient layer for moving function. The first frame 40, the second frame 50 and the third frame 70 are each made from materials such as TPU, nylon or polyurethane. The material can be made rigid or semi-rigid as required. The first frame 40, a second frame 50, and a third frame 70 are linked directly to each other or held in a spaced relation by a low compression material such as TPU, TPR, rubber or EVA, as described below.

The first frame 40 extends generally over the outer sole heel portion 12. The first frame 40 includes a generally flat body 41, and inner posterior cap 42, and outer interior cap 43, and a plurality of rigid or semi-rigid protrusions 44 which extend downwardly.

The second frame 50 extends over both the outer sole heel portion 12 through the outer sole forward portion 14. The second frame 50 includes an arch portion 13 that extends between the outer sole heel portion 12 and the outer sole forward portion 14. The second frame 50 includes a heel portion 51, an arch portion 52 and a forward portion 53. As used herein, a "flexor" is a frame extension forced to a lever function that flexes from the result of a change in the frame border sections which are programmed with weaker characteristics that share the path of the frame lever arm. Frame lever extensions that meet the border sections programmed limit, force the flex zone to react to the opposing borders that are programmed or designed with more compression limit, less compression limit or no compression limit. The weak zone borders altering between different flex limit zones change the extending frame sections direction and lever functions at angles that relay a continual structure change from pressure changes upon the compression limit zones that border these weaker sections. For example, the tuberosity at the base of the fifth metatarsal needs to be free of opposing force during the beginning of the stance phase, described below. Therefore, the foot moves forward to find a weak zone in the area proximal to the posterior base of this metatarsal, the posterior section of the weak zone is limited in compression while the anterior weak zone has no compression limit, therefore, the anterior weak zone frame suspends downward while maintaining stabilization from upward pressure from the posterior frame section.

As used herein a "director" is a weaker section of the frame material that allows the frame to torque or twist. As used herein a "fold zone" is a longitudinal weak section that stabilizes medial lever arm lateral borders and posterior weak flex zone from alternating lateral lever arm and posterior weak flex zone movement during the natural transverse transfer phase from anterior lateral downward pressure to medial toe pressure.

During the "transverse transfer phase", this fold zone moves the frame to an alternate position from the foot demands for shoe stabilization and control during the natural path in motion of the foot. Therefore, the mid-foot is allowed to maintain in shoe positioning while suspending the transverse arches in the non-obstructing frame suspension zones and mid-foot loft zone. While the metatarsal heads and extending toes alternate the pressure shift from lateral stance phase to medial toe off phase, the fold zone interacts with the foot which indicates the path change while transferring demands without shifting the mid-foot out of position. In general, the frame can shift its anterior lateral lever arm and tabs and anterior medial lever arms medial and lateral borders up and down at alternating angles, this is done without interfering with mid-foot stabilization. The movement between the lateral border of the medial lever arm and the medial border of the lateral lever arm is from the longitudinal weak fold zone.

The second frame heel portion 51 includes a plurality of openings corresponding to the locations of first frame protrusions 44. The second frame heel portion 51 also includes a first director 54 and a first frame flex stabilizer 55. The first frame flex stabilizer 55 is structured as a weak zone that extends approximately a half inch longitudinally and one inch inwardly. When the foot moves toward the weak zone, the zone suspends the anterior more rigid frame section downward, levering the anterior inner frame of the inner anterior arch upward, controlled through suspension from the stabilized posterior frame bordering section that is locked from a rigid gripping plantar protrusion. A second director 57 is located at the forward end of the second frame heel portion 51. Second and third frame directors 58, 59 are disposed at the forward end of the second frame arch portion 52.

The second frame forward portion 53 also includes two caps 60, 61 that extend generally downward and perpendicular to the body of the forward portion 53. A first metatarsal pocket 62 is disposed on the inner side of the second frame forward portion 53 adjacent to the second frame arch portion 52. A plurality of flex tabs 63 extend from the medial portion of second frame forward portion 53 to the forward end of second frame forward portion 53. On the inner side of the second frame forward portion 53, i.e. below the big toe, is a lever arm flex director 66.

The third frame assembly 70 extends, generally, over the outer sole forward portion 14. The third frame 70 includes a generally flat body 71 having protrusions 72 which extend downwardly. A plurality of voids 73 are provided between the protrusions.

The reactive upper sole assembly 30 also includes additional layers that couple and space the first frame assembly 40, the second frame assembly 50, and the third frame assembly 70. These layers include a first compression zone 80 and a second compression zone 90. The first and second compression zones 80, 90 are made from nylon, TPU, TPR, EVA, or rubber. The compression zones 80, 90 may be rigid or flexible, have various resiliences and thicknesses. The compression zones 80, 90 have openings therethrough that allow any protrusions 44 to pass. Additionally, there are first and second suspension zones 100, 110 made from nylon, TPU, TPR, EVA or rubber.

The layers of the reactive upper sole assembly 30 and the outer sole assembly 10 are coupled as follows. At the rear end of the sole that will be below the heel of the user, the first frame assembly 40 is disposed closest to the user. Below the first frame assembly 40 is the first compression zone 80. Below the first compression zone 80 is the second frame heel portion 51. Additionally, at the forward end of the first frame assembly 40, the first suspension zone 100 is disposed between the first frame assembly 40 and the second frame assembly arch portion 52. Below the second frame heel portion is the outer sole heel portion 12. The outer sole heel portion protrusions 16, located below the first frame protrusions 44, are hollow. Thus, the first frame protrusions 44 may be moved into or out of the outer sole heel portion protrusions 16.

At the forward end of the sole assembly 1, the second frame forward portion 53 is disposed adjacent to the wear's foot. Below the second frame forward portion 53 is the second compression zone 90. Below the second compression zone 90 is the third frame assembly 70. The third frame assembly 70 also extends rearwardly below the second frame arch portion 52. The second suspension zone 110 is disposed between the second frame arch portion 52 and the third frame assembly 70. Below the third frame assembly 70 is the outer sole forward portion 14. The outer sole heel portion protrusions 16, located below the third frame protrusions 72, are hollow. Thus, the third frame protrusions 72 may be moved into or out of the outer sole heel portion protrusions 16.

A human step, or gait, can be divided into three phases and transitions between those phases. Three phases are heel strike, stance, and toe-off. During use, the sole assembly acts as in the following manner. During the heel strike phase, the first frame assembly protrusions 44 move downward to the compression limit proximal to the rear boarder of the heel portion director 54. This action lock levers on the second frame assembly heel portion 51 upward. The upward movement braces the second frame director 58 located on second frame arch portion 52 and suspends the first metatarsal head pocket 62 while supporting the toe off lever 66.

Upon transitioning to the stance phase, the second frame assembly second director 57 is pushed downward from the stance phase lateral compression of first and second suspension zone 100, 110, as the foot moves to the stance phase. This compression forms a suspension zone for the base of the fifth metatarsal head and the brevis tendon. The lateral compression continues medial stabilization of the second frame assembly 50 and corresponding second frame director 58 to toe off lever 66 while suspending the first metatarsal in the pocket of 62.

Moving from the stance phase to the toe-off phase, the first suspension zone 56 levels and regulates transverse compression of second frame assembly 50. Lateral compression between the second frame assembly 50 and third frame assembly 70 is regulated by lateral compression of the second suspension zone 110. Additionally second frame outer cap 60 compresses the second low compression zone 90 to stabilize the outer side of the sole. Throughout the stance phase compression, third frame protrusions 72 move into outer sole forward portion protrusions 16. This action locks and moves the outer sole protrusions for traction, grip and direction.

When transitioning to the toe off phase, the third director 59 flex zone moves the forward portion of second frame forward portion 53 proximal to upward as the rearward area proximal to the third director moves downward. This engages downward pressure of flex tabs 63 directing transverse stabilization of the toe off lever 66. The transfer of pressure moves inwardly, guided and controlled along the suspended transverse plane of the second suspension zone 110. The transverse medial transfer moves to gradually compress the second frame director 58 controlled by second suspension zone 110 and third frame assembly 70 resistance. This medial compression creates a posterior medial arch suspension zone regulated from internal pressure of the medial section of the first suspension zone 100. That is, the frame wraps the inside of the front half of the inside arch, while the side wrap tapers off to not wrap the rear portion of the medial arch. This creates a suspension zone due to the wear's foot compressing the upper body material in the back arch area with a stabilized front arch wrapped on the side by the rigid frame material regulated from internal pressure of the medial section of the first suspension zone 100.

Proceeding to the toe off phase, the first metatarsal head rolls forward along the suspension pocket of 62. The roll zone is regulated by compression between the inner second frame cap 61 and medial section of third frame assembly 70. The compression of the anterior medial arch releases as the foot moves forward compressing the toe off lever 66. The toe off lever 66 is stabilized by a fold zone created from the inward and downward compression of the tabs 63. The tabs 63 are regulated by and move corresponding tabs (not shown) of the plantar section of the third frame assembly 70. These tabs move downward, creating a longitudinal fold zone between the most medial tabs 63 and the toe off lever 66.

At the final toe off phase, the compression of toe off lever 66 moves the third frame assembly protrusions 72 downward into the voids of the outer sole protrusion 16. The voids are positioned to the posterior section of the external protrusion interior. The third frame assembly protrusions 72 fill the voids to lock, angle and position the external protrusions for traction and gripping, while maintaining direction through toe off.

Another embodiment of the reactive upper sole, according to the present invention, is shown in FIGS. 2-15 and will now be described. According to this embodiment, the reactive upper sole includes a foot bed 200 that is structured to be placed on top of a first frame assembly 40 and the second frame assembly forward portion 53. The foot bed 200 is an insert that is structured to cooperate with the e.g., and mid sole and an outer sole (not shown). The characteristics features of the foot bed 200 may be changed by changing the materials used for manufacture of the foot bed 200 and altering the number and/or location of the various components. For example, a wearer, such as an athlete, may need only one outer sole, but may have a plurality of foot beds 200 each structured to act or function differently. That is, one foot bed 200 may be structured for running on pavement, another for running on cross country trials, and a third foot bed 200 may be structured for climbing rocks.

The foot bed 200 includes a plurality of folding directional levers 201, 202, 203. The first lever 201 extends longitudinally on the outer side of the forward portion of the sole. The second lever 202 extends longitudinally on the inner side of the forward portion. The third lever 203 extends, generally, perpendicular to a longitudinal axis of the foot bed 200 at the arch portion 213. An upper body 210 links the folding directional levers 201, 202, 203 that help the foot control the shoe throughout the toe off phase. The fore foot engages a first anterior lateral lever 201 that alters in angle to move the medial lever tabs 204, 205, 206 at downward angles along front and rear weak zones forming a longitudinal medial fold zone 207 located approximately between the big toe and the second toe and extending longitudinally to the ball of the foot. This movement structures the medial second lever 202 that extends longitudinally bordered by the guiding support of the fold zone. Posterior to the medial second lever 202, an anterior medial arch wrap lever 203 levered by the plantar protrusions that alter in depth allowing the first metatarsal to move and angle the anterior metatarsal head along the suspension zone 221 (described below). This allows the posterior metatarsal and anterior toe to an uninterrupted off phase positioning. The downward lever action of the anterior medial arch moves and stabilizes the medial second lever 202 upward as it supports the front of the medial arch in motion to the toe off phase. These folding directional levers 201, 202, 203 may extend the full length of the foot bed 200. These levers 201, 202, 203 cooperate with the directors in the second frame assembly 50. Thus, the user's foot activates levers in the foot bed 200 which act on the directors in the second frame assembly 50 which, in turn, act on the outer sole 10.

The foot bed 200 typically includes three layers, an upper body 210, a foot bed frame assembly 230, and a foot bed composite 250. In some applications, the foot bed 200 may includes a fourth layer, namely, a canting assembly 260 attached to protrusions of the foot bed frame assembly 230. It is to be appreciated that there may be less layers or the various layers may be combined with one anther to form an integral and unitary structure. The upper body 210 is generally shaped as an insole having a plurality of regions. The regions are made from different materials, or different compositions of a single material, so that each region has a specific resiliency. The upper body 210 has an upper surface 211 and a bottom surface. Some regions of the body may overlie other regions of the other components of the foot bed 200 as described below in further detail.

Figure 3:
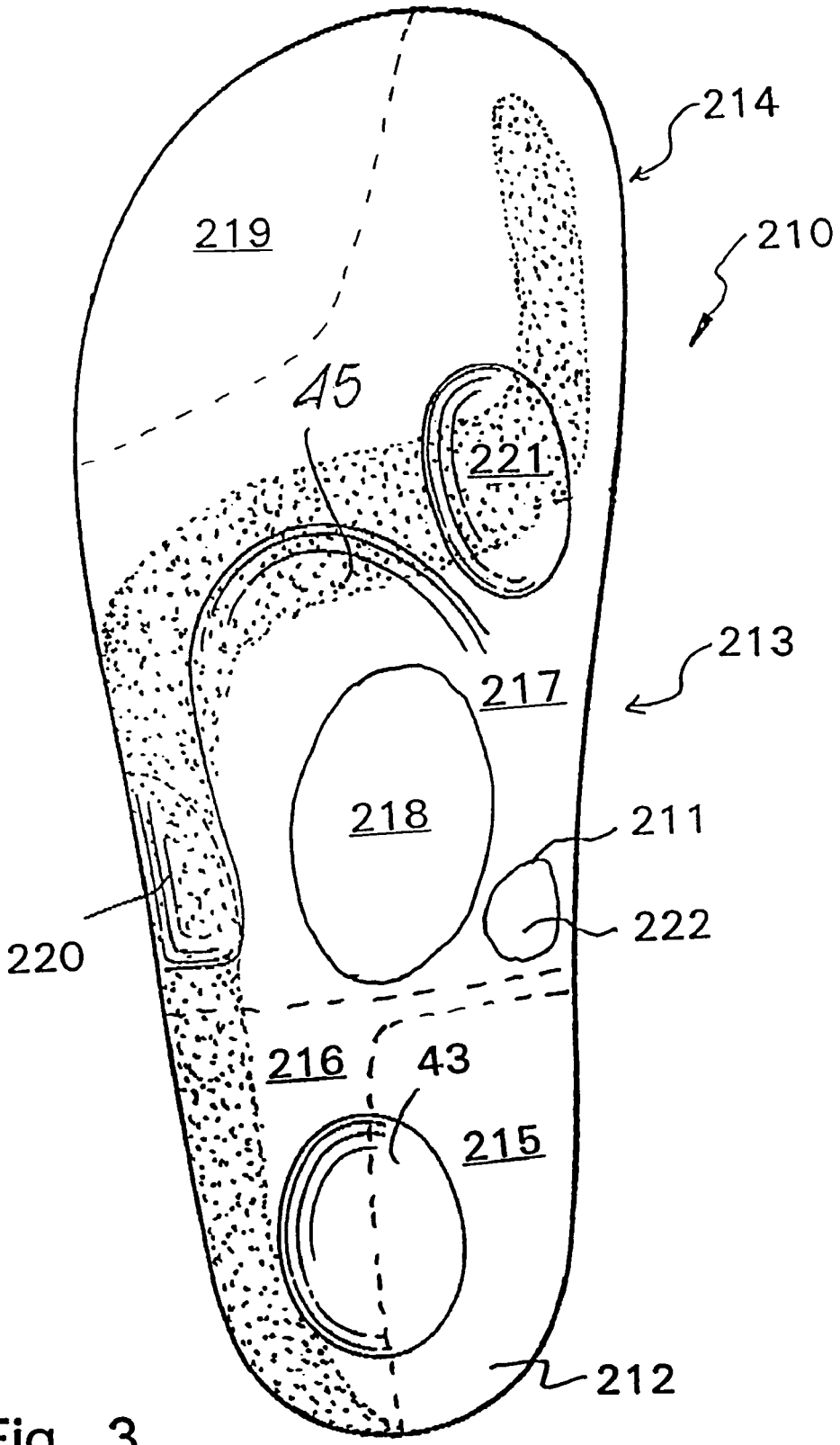
FIG. 3 is diagrammatic top plan view of FIG. 2.
Figure 4:
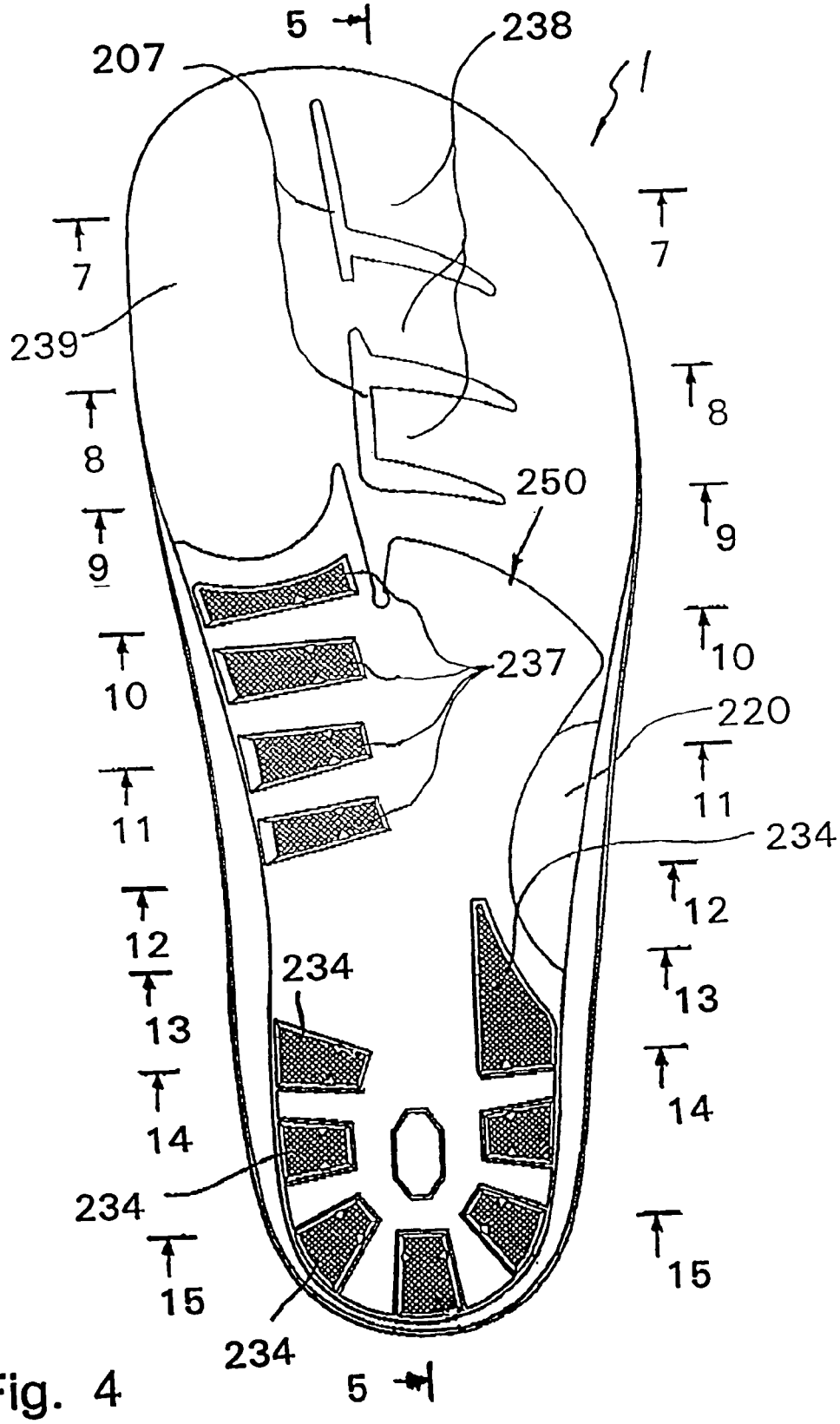
FIG. 4 is diagrammatic bottom plan view of FIG. 2.
Figure 5:
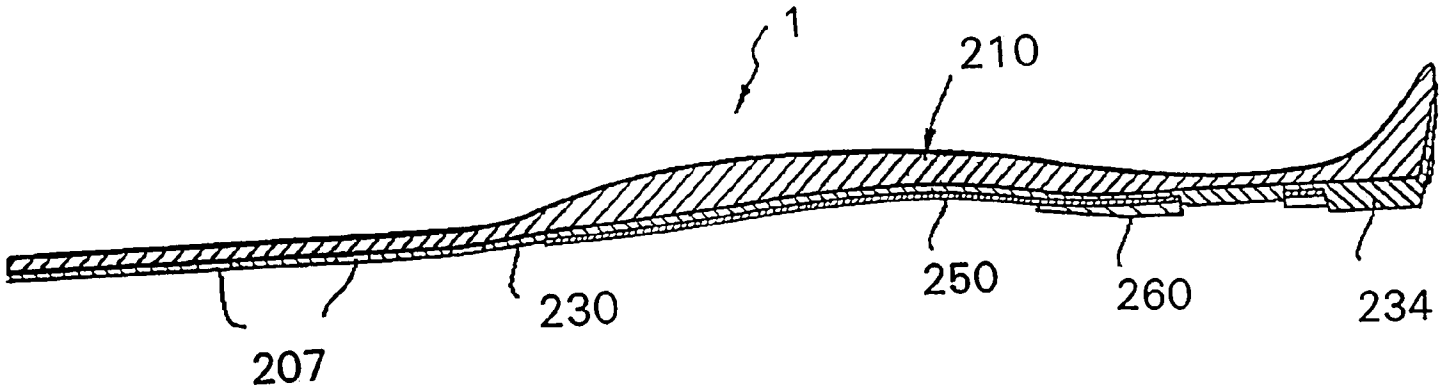
FIG. 5 is diagrammatic cross-sectional view along section line 5-5 of FIG. 2.

The upper body 210 includes a heel portion 212, an arch portion 213, and a forward portion 214 (FIG. 3). The foot bed 200 has an inner side and an outer side corresponding to the inner and outer sides of a human foot. The elongate side of the sole 1 that is structured to contact a user's big toe is referred to as the "inner" side of the sole 1, and the elongate side of the sole that is structured to contact the user's little toe is referred to as the "outer" side. A first region 215, located at the inner side of the foot bed heel portion 212, is manufactured from a firm material, such as nylon, TPU, or TPR. A second region 216, located at the outer side of foot bed heel portion 212, manufactured from a less firm composition such as EVA. A third region 217, extending from the heel portion 212 over the arch portion 213 and along the inner side of the forward portion 214, is manufactured from a firm material such as nylon, TPU, or TPR. A fourth region 218, surrounded by the third region 217 is manufactured from a soft material, such as EVA or urethane, and is structured to support the arch of the wear's foot during use. A fifth region 219, located on the outer side of foot bed forward portion 214, is manufactured from a firmer material such as EVA or urethane.

A first foot bed suspension zone 220 is provided on the outer side of the foot bed arch portion 213. The first foot bed suspension zone 220 is provided in the third region 217. A second foot bed suspension zone 221 is located on the inner side between the foot bed arch portion 213 and the foot bed forward portion 214. A third foot bed suspension zone 222 is located on the inner side between the foot bed heel portion 212 and the foot bed arch portion 213. The three suspension zones tend to be softer areas than the remainder of the foot bed 200.

Figure 2:
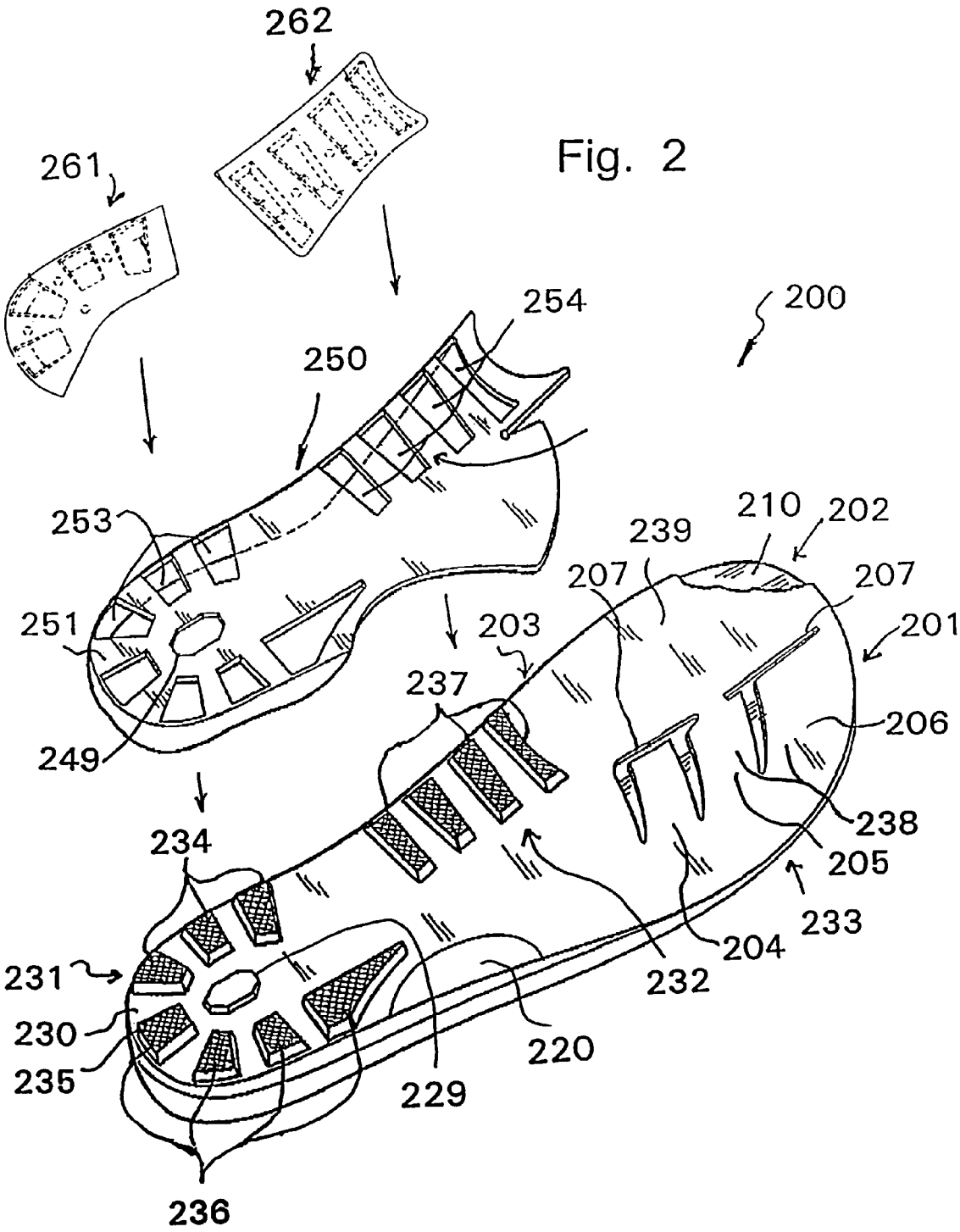
FIG. 2 is a diagrammatic exploded perspective view of a second embodiment showing the various components for the sole assembly according to the present invention.

The foot bed frame assembly 230 typically includes a heel portion 231, an arch portion 232, and a forward portion 233 (FIG. 2). The foot bed frame assembly 230 is manufactured from a rigid material such as nylon, TPU, or TPR. The foot bed frame assembly heel portion 231 includes a plurality of heel protrusions 234, e.g., seven heel protrusions, which extend around and radially about the periphery of the foot bed heel portion 231. The plurality of foot bed heel protrusions 234 each have a flat radially outer area 235 and may have an inclined radially inner area (not shown) which is inclined toward or tapers toward a base of the foot bed frame assembly 230. The inclined radially inner area, if present, generally is angled toward and directed at a center of the foot bed frame assembly heel portion 231. The first plurality of foot bed protrusions 234 do not overly either the first or third foot bed suspension zones 220, 222. An opening may be formed in a central region of foot bed frame assembly heel portion 231. All of the heel protrusions 234 can have identical physical properties or characteristics. Alternatively, the heel protrusions 234 located on the inner side of the sole can be manufactured from a harder material while the heel protrusions 234 located on the outer side of the sole can be manufactured from a softer more resilient material. The softer more resilient material will assist the foot in follow its normal walking path and avoid early pronation of the foot.

Figure 6:
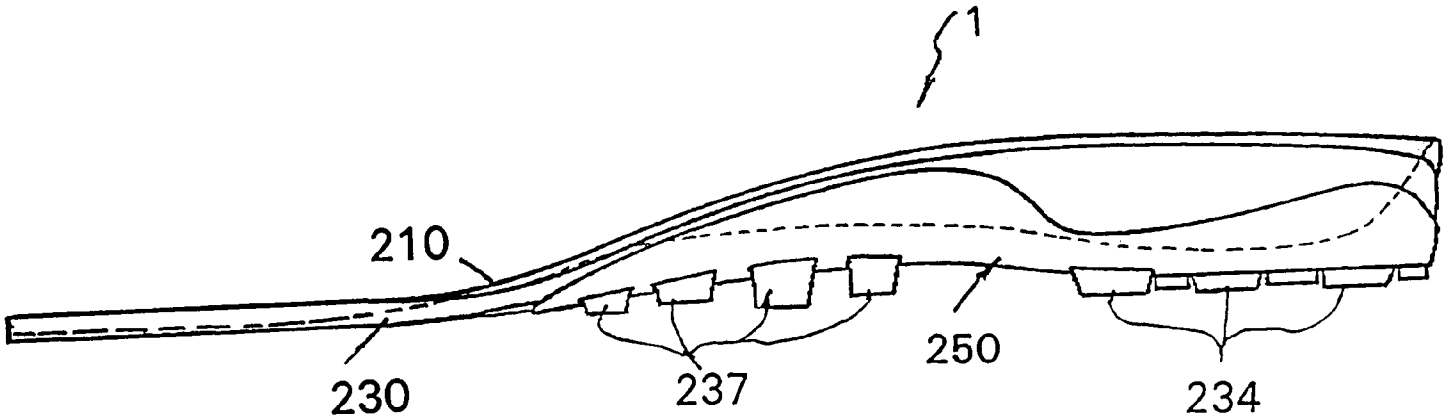
FIG. 6 is diagrammatic inner side elevational view of FIG. 2.

A plurality of foot bed arch protrusion 237, e.g., four sequentially arranged arch protrusions, are located on the inner side of the foot bed arch portion. Each arch protrusions 237 is an elongated protrusion having a longitudinal axis extending generally perpendicular to the inner side of the foot bed frame assembly arch portion 232. The forward edge of each arch protrusions 237 is angled forward, away from the heel portion, toward the forward portion 214 of the sole. All of the heel and arch protrusions 234, 237 project downwardly away from a base of the foot bed frame assembly 230 (FIG. 6). The outer side of the forward portion 233 of the foot bed frame assembly 230 includes a plurality of foot bed tabs 238 while the inner side thereof includes a diving board or toe off lever 239. All of the arch protrusions 237 can have identical physical properties or characteristics. Alternatively, one or both of the arch protrusions 237 located toward the forward portion 214 of the sole can be manufactured from a softer more resilient material while the remaining arch protrusions 237 located adjacent the heel portion 212 of the sole can be manufactured from a firmer material. The softer more resilient material will assist with a gentle lowering of the arch.

Figure 6A:
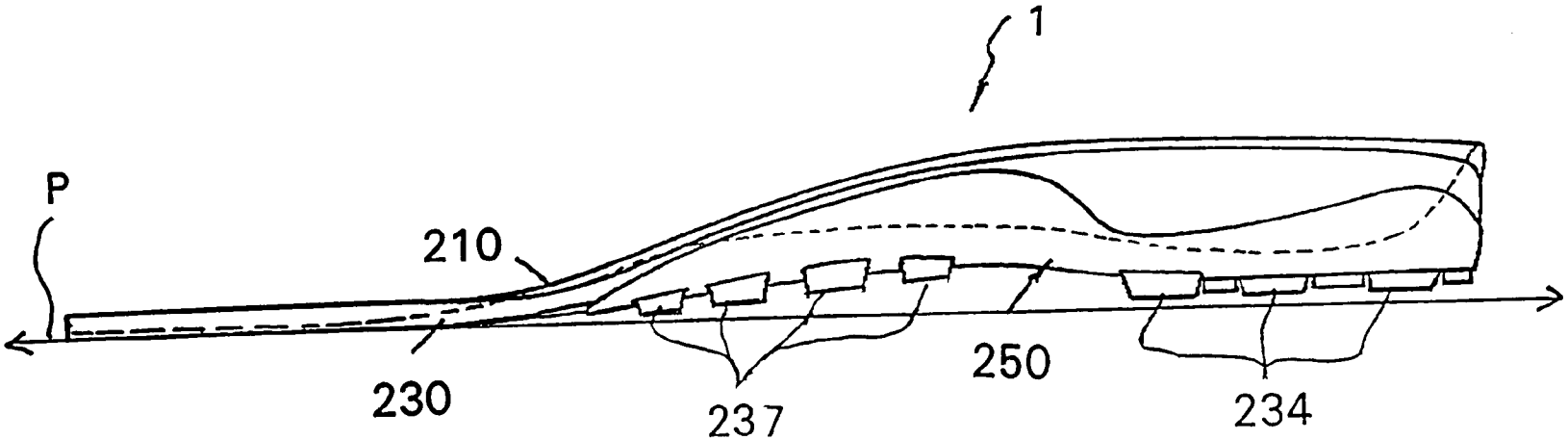
FIG. 6A is diagrammatic inner side elevational view of the inner sole showing another variant of the arch protrusions.

A slight variation of the arch protrusions is shown in FIG. 6A. As can be seen in this Figure, the sole difference between this embodiment and that of FIG. 6 is the height of the arch protrusions 237 is altered. That is, in this embodiment the arch protrusion 237 located closest to the forward portion of the sole extends downward and has a bottom surface which is coincident with a plane P defined by a base of the foot bed 200. The arch protrusion 237 next closest to the forward portion 214 of the sole extends downward toward but has a bottom surface which does not completely extend to be coincident with the plane P defined by the base of the foot bed 200. The arch protrusion 237 third closest to the forward portion 214 of the sole extends downward toward but also has a bottom surface which does not extend to or is coincident with the plane P defined by the base of the foot bed 200. Lastly, the arch protrusion 237 closest to the heel portion 212 extends downward toward but has a bottom surface which is spaced furthest away from the plane P defined by the base of the foot bed 200. In all other respects, this embodiment is substantially identical to that of FIG. 6.

Figure 6B:
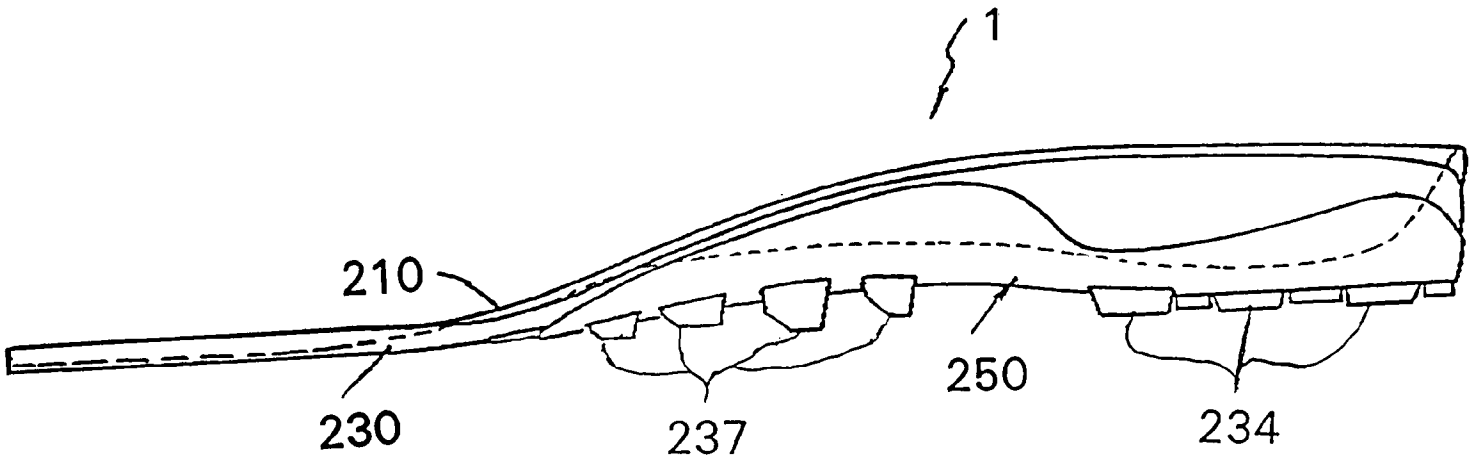
FIG. 6B is diagrammatic inner side elevational view of the inner sole showing a third variant of the arch protrusions.
Figure 7:
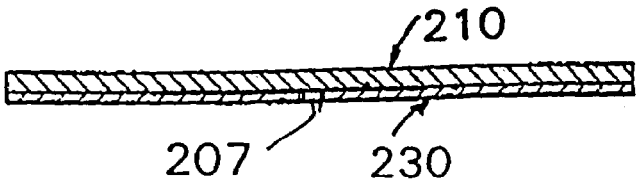
FIG. 7 is diagrammatic cross-sectional view along section line 7-7 of FIG. 2.
Figure 8:
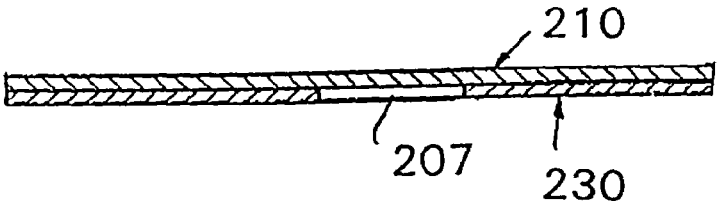
FIG. 8 is diagrammatic cross-sectional view along section line 8-8 of FIG. 2.
Figure 9:
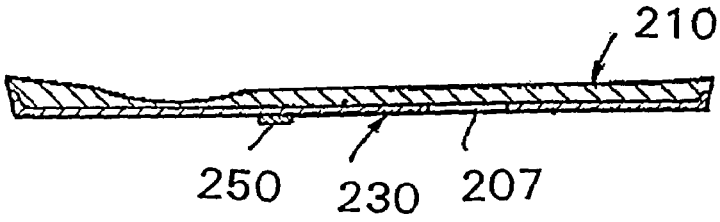
FIG. 9 is diagrammatic cross-sectional view along section line 9-9 of FIG. 2.
Figure 10:
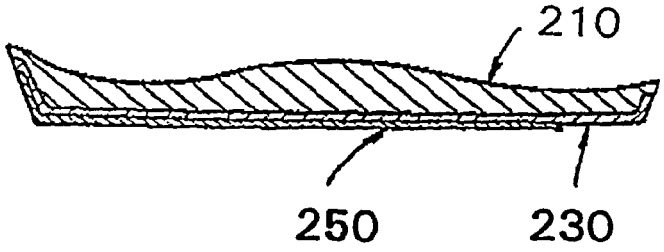
FIG. 10 is diagrammatic cross-sectional view along section line 10-10 of FIG. 2.
Figure 11:
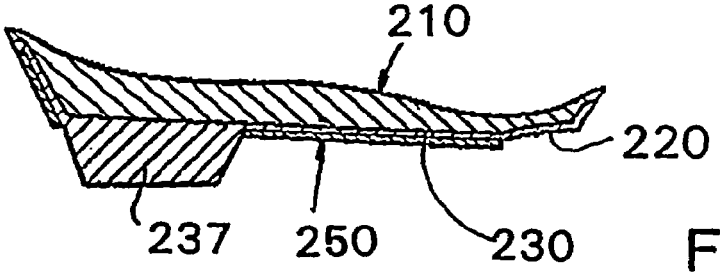
FIG. 11 is diagrammatic cross-sectional view along section line 11-11 of FIG. 2.

A further variation of the arch protrusions is shown in FIG. 6B. As can be seen in this Figure, the shape of the arch protrusions 237 is slightly varied from that of FIG. 6. The sole difference between this embodiment and that of FIG. 6 is that the entire length of the forward most, downwardly facing edge of each one of the arch protrusions 237 is beveled or chamfered. In all other respects, this embodiment is substantially identical to that of FIG. 6.

The foot bed composite 250 (FIG. 2) is generally a rigid assembly manufactured from nylon, TPU, or a composite fiber, for example. The foot bed composite 250 has a heel portion 251 and an arch portion 252. The composite heel portion 251 includes a plurality of heel openings 253 corresponding in size, shape and location to receive the heel protrusions 234. The composite arch portion 252 includes a plurality of arch openings 254 corresponding in size, shape and location to receive the plurality of arch protrusions 237. It is to be appreciated that the foot bed composite 250 does not obstruct any of the suspension zones 220, 221, 222. The foot bed composite 230 also has a medial opening 249 in the heel portion 251. The foot bed composite 250 is cambered upward to support the arch of the user.

If the foot bed 200 includes a fourth layer, this layer generally comprises a canting assembly 260 which includes two clips 261, 262. The clips 261, 262 are structured to change a heel lift plane. One clip is structured to attach to a group of the plurality of heel protrusions 234, e.g., four of the heel protrusions located along the inner side of the sole, while the second clip 262 is structured to attach to all of the arch protrusions 237. Each one of the two clips 260, 262 has a plurality of mating cavities formed therein with each one of the mating cavities sized, shaped and located to receive one of the respective heel or arch protrusions 234, 237. The two clips 260, 262, once attached, combine with one another to form a plane that tapers or a two piece plane that forms one even plane. The clips 261, 262 increase the spacing of the upper surface of the body heel portion 212, along the inner side, relative to a remainder of the shoe sole. That is, the foot bed 200 is generally flat at the second suspension zone 221 and thicker at the inner side of the heel. Preferably, the taper between the heel and the second suspension zone 221 for the first metatarsal head is between about 2 to 4 degrees.

The foot bed 200 is assembled as follows. The upper body 210 forms the uppermost top layer which is located to contact and engage with the wear's foot. The next top most layer is the foot bed frame assembly 230. The foot bed composite 250 is attached to the foot bed frame assembly 230 with the plurality of heel protrusions 234 extending through the plurality of heel openings 253 and the plurality of arch protrusions 237 extending through the plurality of arch openings 254. If desired or necessary, the canting assembly 260, 262 are attached to the plurality of heel and arch protrusions 234, 237. The main object is the canting assembly 260 is to change the plane of the foot bed, starting with a lift of the heel that has a gradual angle that tapers longitudinally downward toward the front outer side of the sole such that there is virtually no lift behind the first metatarsal.

With reference to the conventional three phases of a step, with a transition between each of the three phases, the foot bed 200 operates as follows. The heel strikes first while the plurality of heel protrusions 234 flex to stabilize against posterior foot bed frame assembly arch portion 232 distortion, the heel shape centers between body first region 215 and second region 216 of the heel portion 212. The firm first region 215 stabilizes against early pronation while the soft second region 216 flexes forming a heel roll zone.

As the foot moves toward the stance phase, the plurality of heel protrusions 234 slope downward to a void in the posterior of the foot bed frame assembly arch portion 232. The tuberosity of the base of the fifth metatarsal head suspends into a semi firm body third region 217 supporting a pocket of the first foot bed suspension zone 220. The suspension is maintained by the posterior void by plurality of heel protrusions 234 and the anterior void of the foot bed frame assembly arch portion 232 camber. Camber is created in the foot bed frame assembly arch portion 232 from the void between the height and angle of the most lateral section of the plurality of heel protrusions 234 and the most lateral anterior level transverse plane of the foot bed frame assembly arch portion 232. As the lateral foot suspends into the first foot bed suspension zone 220, the head of the first metatarsal suspends into a medial pocket of the second foot bed suspension zone 221. The first metatarsal head is suspended because the plurality of heel protrusions 234 are angled forward with an alteration in depth between the protrusions. As pressure is placed upon the plurality of heel protrusions 234, the plurality of heel protrusions 234 move downward and forward with a spring effect forming the second foot bed suspension zone 221. During the stance phase, the medial and lateral suspension zones position the frame for least resistance to multiple foot shapes, and the mid-foot is cradled as it falls on a large convex soft fourth region 218.

As the foot moves towards the toe off phase, the most anterior lateral protrusion of the plurality of heel protrusions 234 maintain lateral suspension in first foot bed suspension zone 220 while the camber in the anterior lateral section of the foot bed frame assembly arch portion 232 flexes downward. The downward pressure moves to transfer medially as the fifth region 219 and medial frame toe off lever 239 resists compression, the medial transfer moves center tabs of the medial mid section of anterior frame section, including the foot bed tabs 238, downward. This stabilizes a fold zone 207 between the anterior lateral frame section levers and the medial toe of lever of the medial frame toe off lever 239. The materials of the anterior frame sections are semi rigid, rigid type materials of TPU, nylon type.

During the toe off phase, the medial portion of the plurality of heel protrusions 234 flex downward and angle forward, this supports the anterior section of the medial arch, while suspending the lateral section of the medial arch along a frame void adjacent to third foot bed suspension zone 222. The third foot bed suspension zone 222 allows the lateral arch to adjust the flexion of the soft body of second region 216 and semi firm body third region 217. The lateral arch suspension zone allows the foot to engage the toe off sequence without resistance to the natural path to the foot from the frames. At toe off, the first metatarsal head rolls forward on the second foot bed suspension zone 221, the zone is suspended between the engaged plurality of heel protrusions 234 and the anterior toe off lever 239. The first metatarsal head flexes the base of the fold zone toe off lever 239 to release all posterior frame compression for a stabilized and controlled toe off.

With reference to FIGS. 16-30, a third embodiment of the reactive upper sole, according to the present invention will now be described. According to this embodiment, the reactive upper sole includes a foot bed 300 that is structured to be placed on top of a first frame assembly 40 and the second frame assembly forward portion 53. The foot bed 300 is an insert that is structured to cooperate with the e.g., and mid sole and an outer sole (not shown). The characteristics features of the foot bed 300 may be changed by changing the materials used for manufacture of the foot bed 300 and altering the number and/or location of the various components.

The foot bed 300 includes a plurality of folding directional levers 301, 302, 303. The first lever 301 extends longitudinally on the outer side of the forward portion of the sole. The second lever 302 extends longitudinally on the inner side of the forward portion. The third lever 303 extends, generally, perpendicular to a longitudinal axis of the foot bed 200 at the arch portion 313. An upper body 310 links the folding directional levers 301, 302, 303 that help the foot control the shoe throughout the toe off phase. The fore foot engages a first anterior lateral directional lever 301 that alters in angle to move the medial lever tabs 304, 305, 306 at downward angles along front and rear weak zones forming a longitudinal medial fold zone 307 located approximately between the big toe and the second toe and extending longitudinally to the ball of the foot. This movement structures a medial directional lever 302 that extends longitudinally bordered by the guiding support of the fold zone. Posterior to the medial directional lever 302, and the anterior medial arch wrap directional lever 303 are levered by the plantar protrusions that alter in depth allowing the first metatarsal to move and angle the anterior metatarsal head along the second suspension 321 (described below). This allows the posterior metatarsal and anterior toe to an uninterrupted off phase positioning. The downward lever action of the anterior medial arch moves and stabilizes the medial directional lever 302 upward as it supports the front of the medial arch during motion to the toe off phase. These folding directional levers 301, 302, 303 may extend the full length of the foot bed 300 and cooperate with the directors in the second frame assembly 50. Thus, the user's foot activates levers in the foot bed 300 which act on the directors in the second frame assembly 50 which, in turn, act on the outer sole 10.

The foot bed 300, according to this embodiment, includes only two layers, a combined upper body and frame assembly 310 and a foot bed composite 350. In some applications, the foot bed 300 may includes a third layer, namely, a canting assembly attached to protrusions of the combined upper body frame assembly 310. The body 310 is generally shaped as an insole having a plurality of regions. The regions are made from different materials, or different compositions of a single material, so that each region has a specific resiliency. The body 310 has an upper surface 311 and a bottom surface. Some regions of the body may overlie other regions of the other components of the foot bed 300 as described below in further detail.

Figure 17:
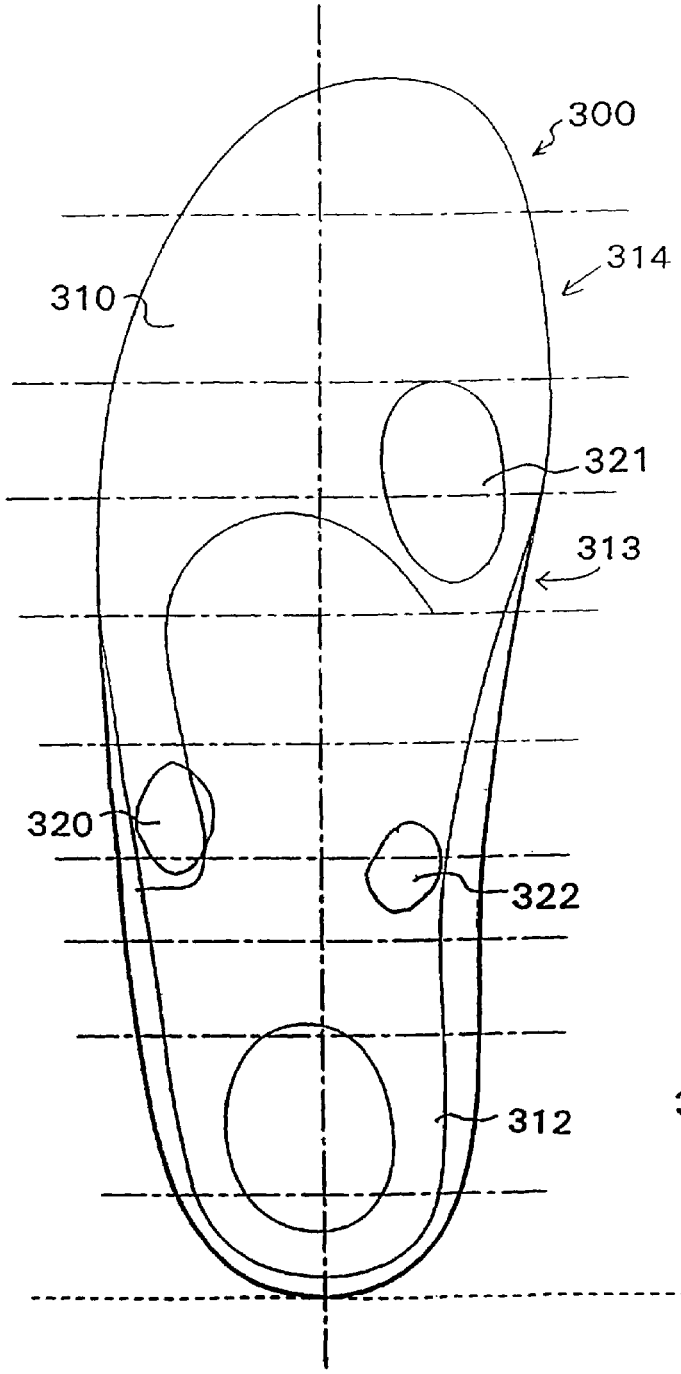
FIG. 17 is diagrammatic top plan view of FIG. 16.

The body 310 includes a heel portion 312, an arch portion 313, and a forward portion 314 (FIG. 17). The foot bed 300 has an inner side and an outer side corresponding to the inner and outer sides of a human foot. A first region 215, located at the inner side of the foot bed heel portion 312 (see FIG. 21), is manufactured from a firm material, having an EVA hardness of 45 C, for example. A second region 216, located at the outer side of foot bed heel portion 212, is manufactured from a less firm composition having an EVA hardness of 35 C, for example. A third region 217, extending from the heel portion 212 over the arch portion 213 and along the inner side of the forward portion 214, is manufactured from nylon, TPU, or TPR having a hardness of about 45 C, for example. A fourth region 218, surrounded by the third region 217 is manufactured from a soft material, such as EVA or urethane, having a hardness of 35 C, for example, and is structured to support the arch of the wear's foot during use. A fifth region 219, located on the outer side of foot bed forward portion 214, is manufactured from EVA or urethane having a hardness of 55 C, for example.

A first foot bed suspension zone 320 is provided on the outer side of the foot bed arch portion 313. The first foot bed suspension zone 320 is provided in the third region 217. A second foot bed suspension zone 321 is located on the inner side between the foot bed arch portion 313 and the foot bed forward portion 314. A third foot bed suspension zone 322 is located on the inner side between the foot bed heel portion 212 and the foot bed arch portion 213. The three suspension zones tend to be softer areas than the remainder of the foot bed 300.

Figures 16, 20:
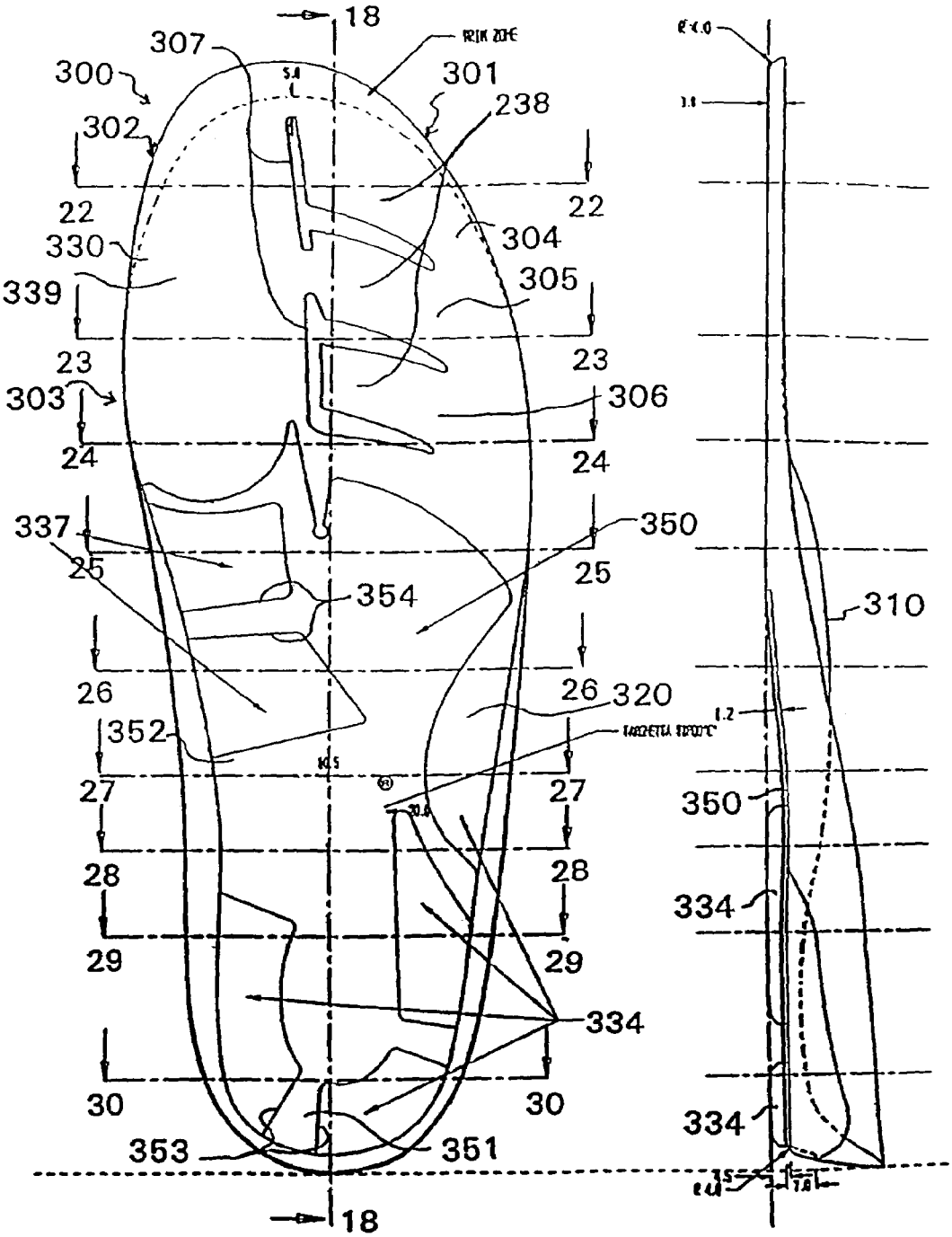
FIG. 16 is diagrammatic bottom plan view of a third embodiment of the various components for the sole assembly according to the present invention.
FIG. 20 is diagrammatic outer side elevational view of FIG. 16.
Figure 19:
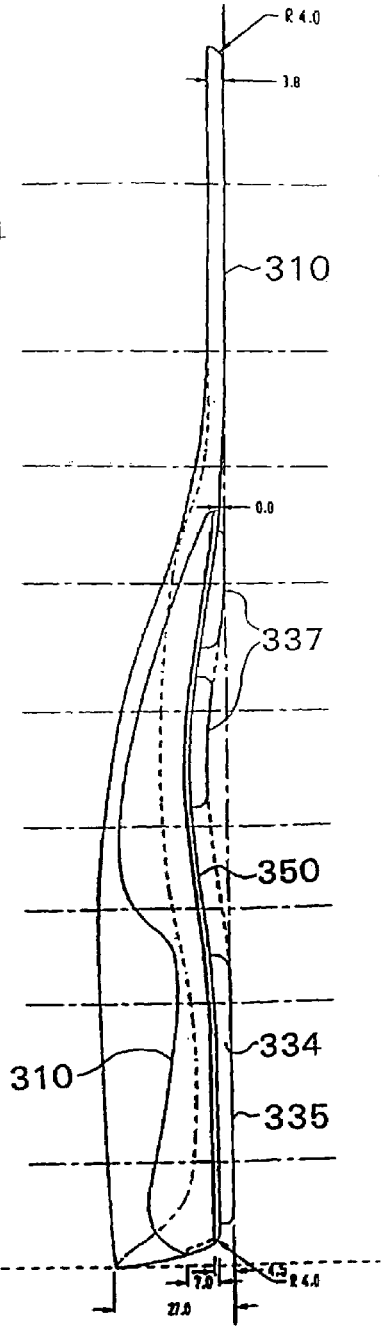
FIG. 19 is diagrammatic inner side elevational view of FIG. 16.
Figure 18:
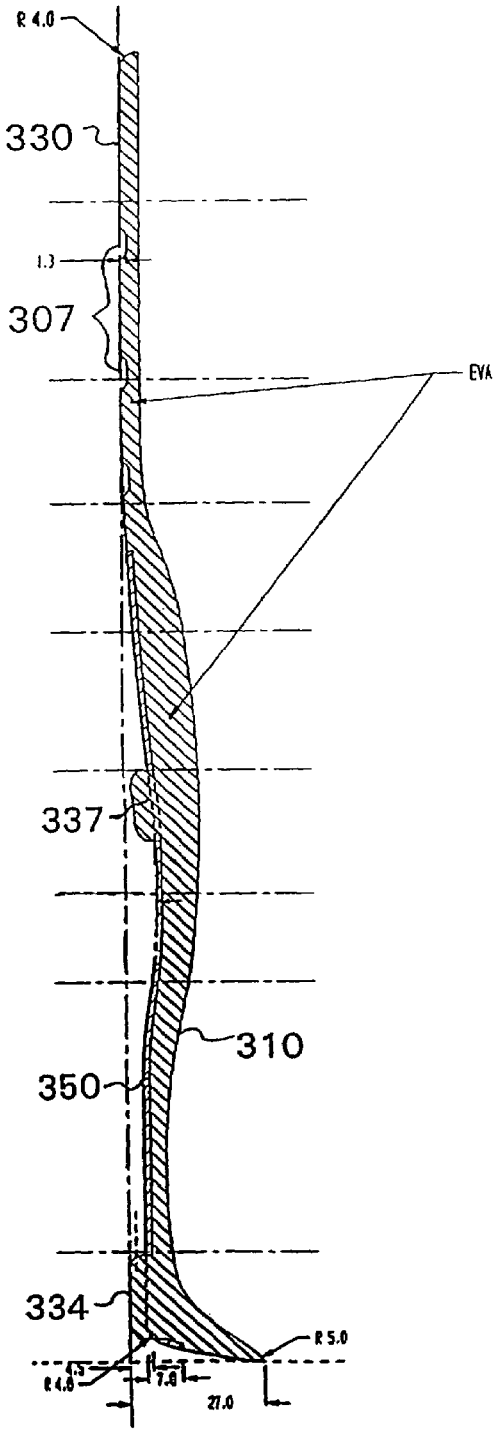
FIG. 18 is diagrammatic cross-sectional view along section line 18-18 of FIG. 16.
Figure 21:
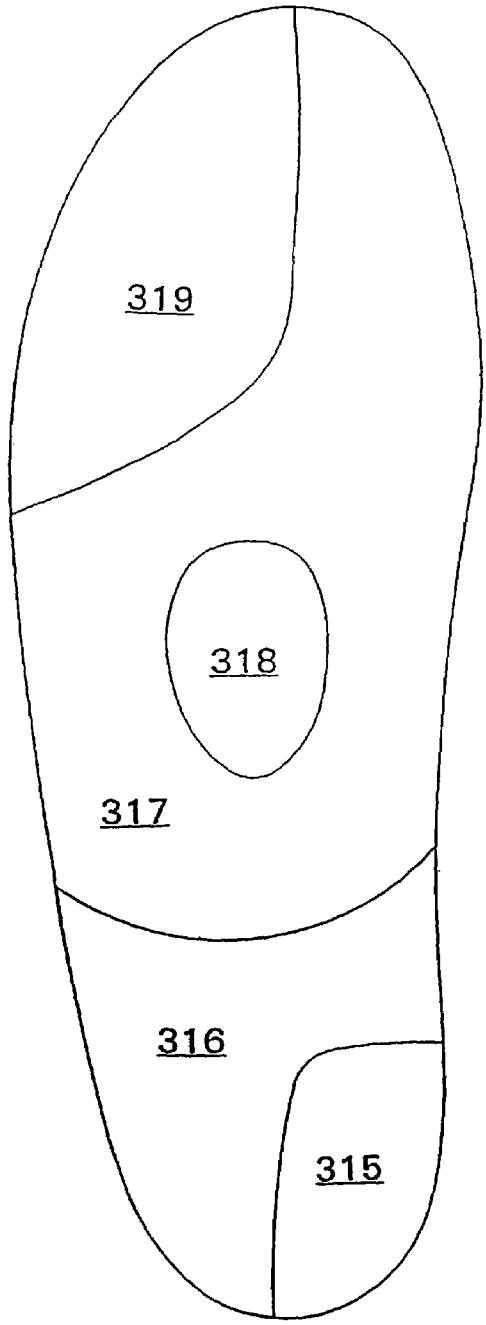
FIG. 21 is diagrammatic cross-sectional top plan view of FIG. 16 showing the various regions of the inner sole.
Figure 22:
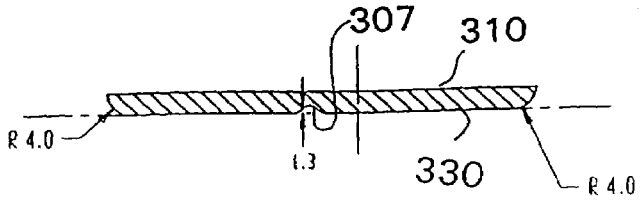
FIG. 22 is diagrammatic cross-sectional view along section line 22-22 of FIG. 16.
Figure 23:
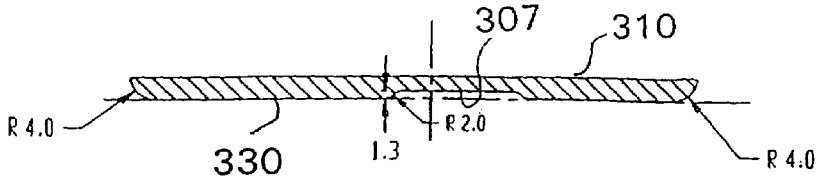
FIG. 23 is diagrammatic cross-sectional view along section line 23-23 of FIG. 16.
Figure 24:
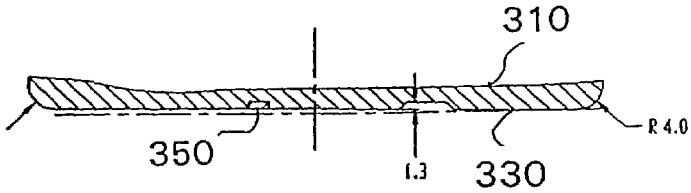
FIG. 24 is diagrammatic cross-sectional view along section line 24-24 of FIG. 16.
Figure 25:
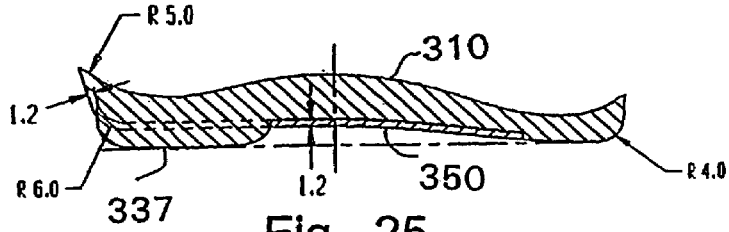
FIG. 25 is diagrammatic cross-sectional view along section line 25-25 of FIG. 16.
Figure 26:
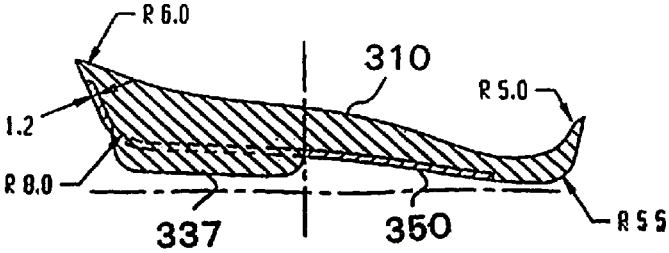
FIG. 26 is diagrammatic cross-sectional view along section line 26-26 of FIG. 16.
Figure 31:
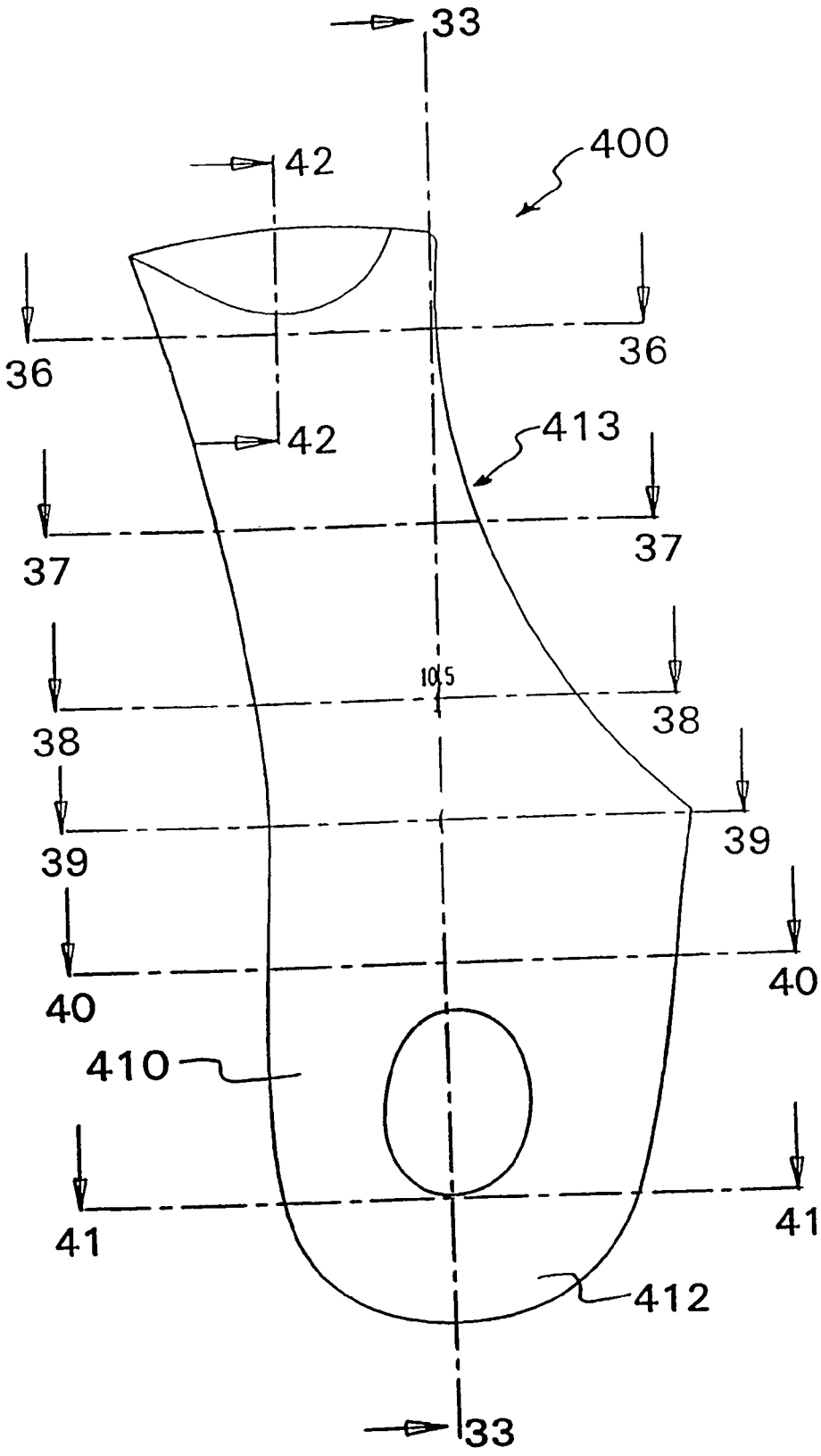
FIG. 31 is diagrammatic bottom plan view of a third embodiment showing the most simplified form for the sole assembly according to the present invention.
Figure 32:
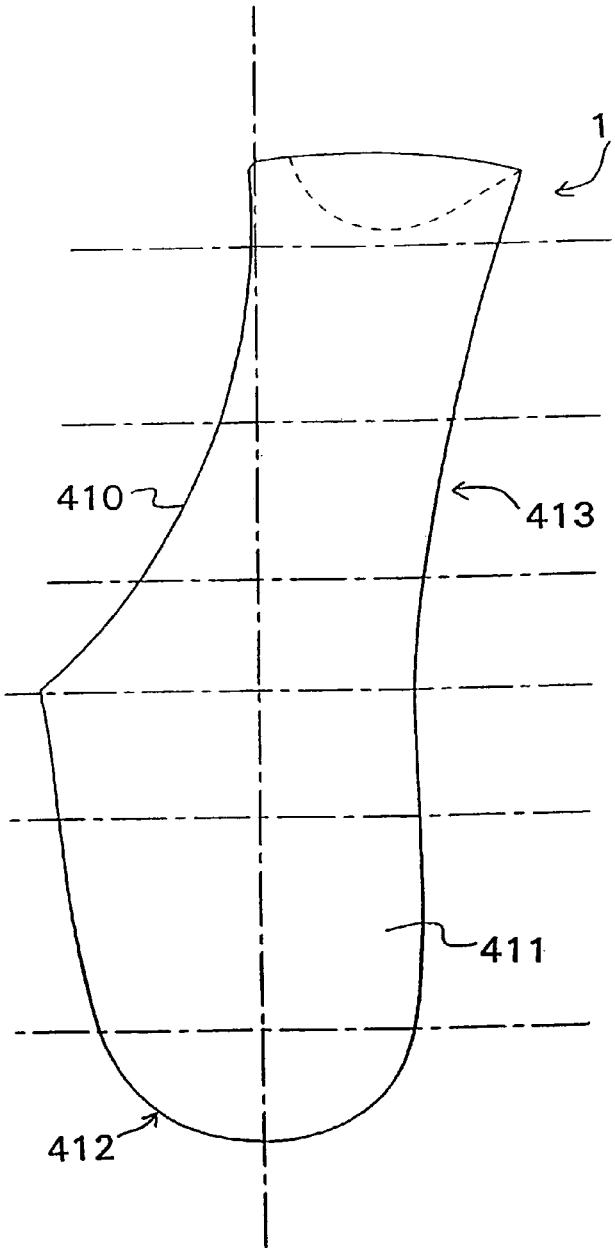
FIG. 32 is diagrammatic top plan view of FIG. 31.
Figure 34:
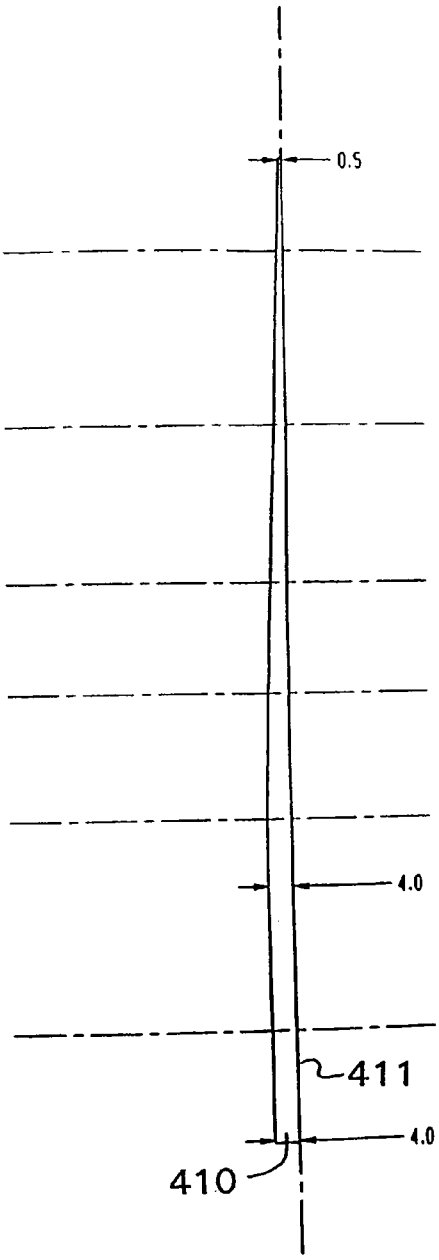
FIG. 34 is diagrammatic inner side elevational view of FIG. 31.
Figure 35:
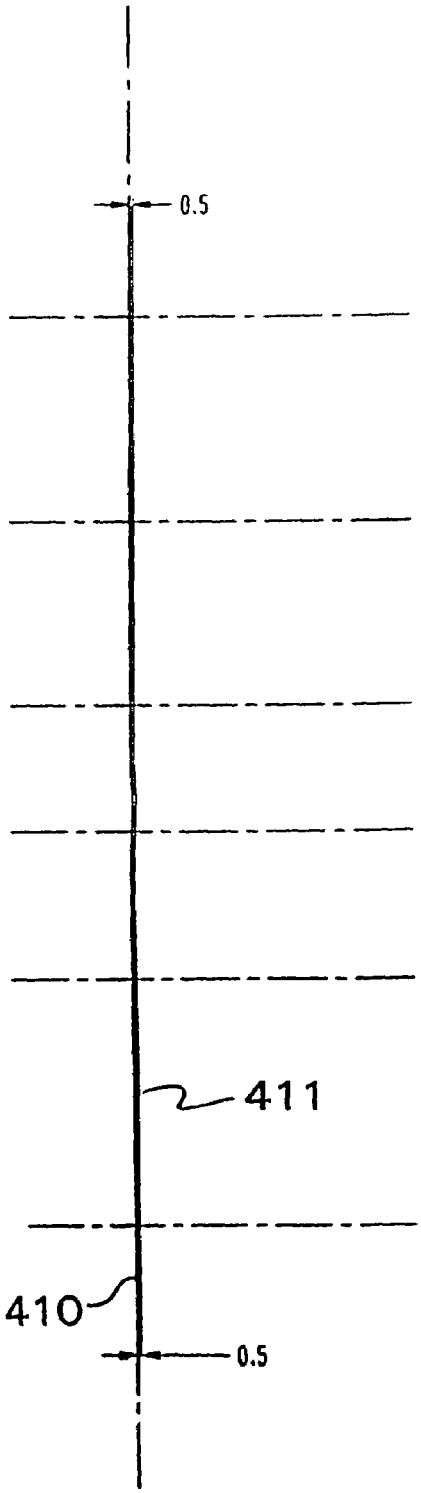
FIG. 35 is diagrammatic outer side elevational view of FIG. 31.
Figure 33:
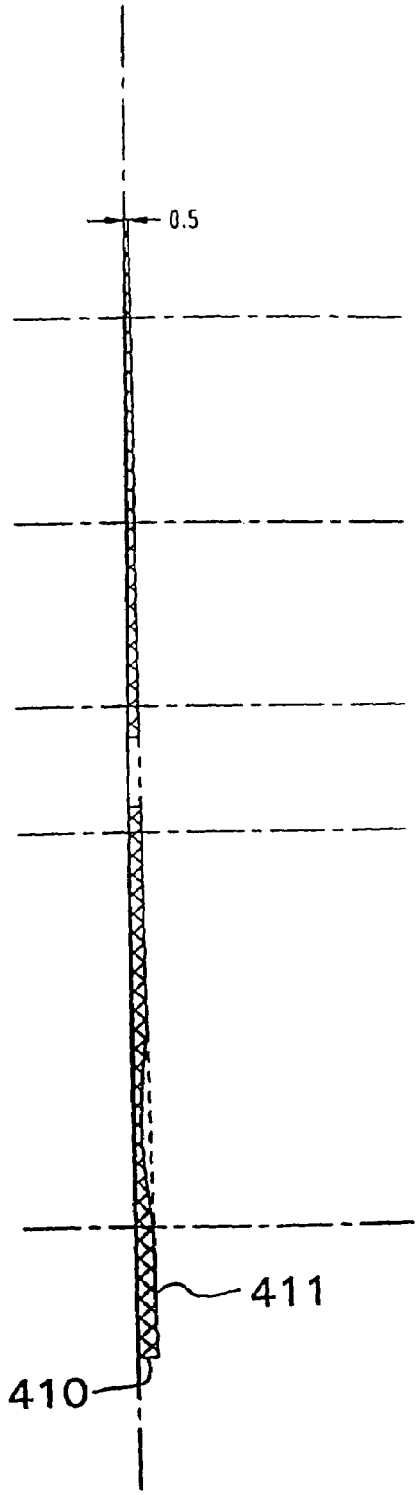
FIG. 33 is diagrammatic cross-sectional view along section line 33-33 of FIG. 31.
Figure 36:
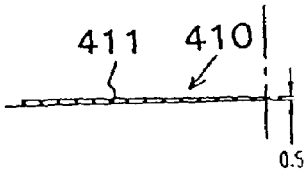
FIG. 36 is diagrammatic cross-sectional view along section line 36-36 of FIG. 31.
Figure 37:
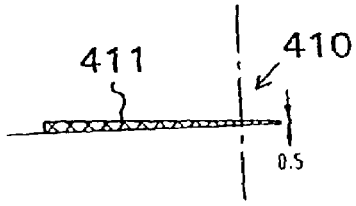
FIG. 37 is diagrammatic cross-sectional view along section line 37-37 of FIG. 31.
Figure 38:
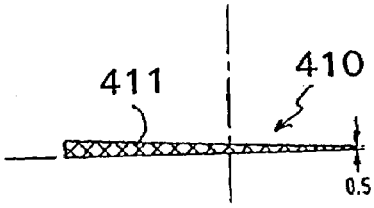
FIG. 38 is diagrammatic cross-sectional view along section line 38-38 of FIG. 31.
Figure 39:
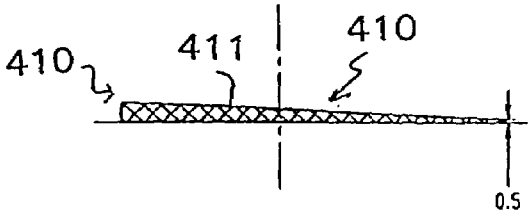
FIG. 39 is diagrammatic cross-sectional view along section line 39-39 of FIG. 31.
Figure 40:
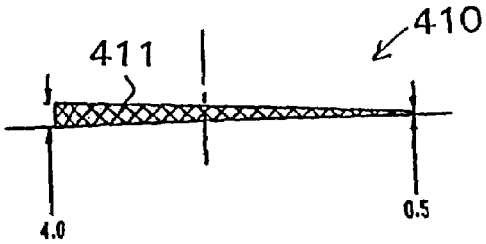
FIG. 40 is diagrammatic cross-sectional view along section line 40-40 of FIG. 31.
Figure 41:
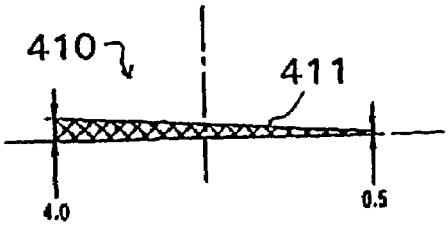
FIG. 41 is diagrammatic cross-sectional view along section line 41-41 of FIG. 31.
Figure 42:
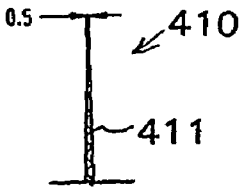
FIG. 42 is diagrammatic cross-sectional view along section line 42-42 of FIG. 31.

The body 310 includes a plurality of heel protrusions 234, e.g., three heel protrusions, which extend around and radially about the periphery of the foot bed heel portion 231 (FIG. 16). The plurality of foot bed heel protrusions 234 each have a flat end face 335 (FIG. 19). The first plurality of foot bed protrusions 334 do not overly either the first or third foot bed suspension zones 320, 322. All of the heel protrusions 334 can have identical physical properties or characteristics. Alternatively, the heel protrusion(s) 334 located on the inner side of the sole can be manufactured from a harder material while the heel protrusion(s) 334 located on the outer side of the sole can be manufactured from a softer more resilient material. The softer more resilient material will assist the foot in follow its normal walking path and avoid early pronation of the foot.

A plurality of foot bed arch protrusion 237, e.g., two sequentially arranged arch protrusions, are located on the inner side of the foot bed arch portion. All of the arch protrusions 337 can have identical physical properties or characteristics. Alternatively, the arch protrusion 337 located toward the forward portion of the sole can be manufactured from a softer more resilient material while the arch protrusion 337 located adjacent the heel portion of the sole can be manufactured from a softer material. The softer more resilient material will assist with a gentle lowering of the arch.

All of the heel and arch protrusions 334, 337 extend downwardly away from a base of the foot bed frame assembly 330. The outer side of the forward portion 314 of the foot bed frame assembly 330 includes a plurality of foot bed tabs 338 while the inner side thereof includes a diving board or toe off lever 339.

The foot bed composite 350 is generally a rigid assembly manufactured from nylon, TPU, or a composite fiber, for example. The foot bed composite 350 has a heel portion 351 and an arch portion 352 and possibly a forward portion (not shown). The composite heel portion 351 includes a plurality of heel openings 353 corresponding in size, shape and location to receive the heel protrusions 334. The composite arch portion 352 includes a plurality of arch openings 354 corresponding in size, shape and location to receive the plurality of arch protrusions 337. It is to be appreciated that the foot bed composite 350 does not obstruct any of the suspension zones 320, 321, 322. The foot bed composite 330 may have a medial opening in the heel portion. The foot bed composite 350 is cambered upward to support the arch of the user.

The foot bed 300 may include a canting assembly (not shown) which includes two clips (not shown). The clips are structured to change a plane from heel lift plane. One clip is attached to the plurality of heel protrusions 334, e.g., the heel protrusion(s) located on the inner side of the sole, while the second clip is structured to attach to the arch protrusions 337. The two clips, once attached, combine with one another to form a plane that increases the spacing of the upper surface of the body heel portion 312 relative to a bottom of the shoe sole 300. That is, the foot bed 300 is generally flat at the second suspension zone 321 and thicker at the inner side of the heel. Preferably, the taper between the heel and the second suspension zone 321 for the first metatarsal head is between about 2 to 4 degrees.

The foot bed 300 is assembled as follows. The body 310 forms the uppermost top layer which is located to contact and engage with the wear's foot. The foot bed composite 350 is attached to the body 310 with the plurality of heel protrusions 334 extending through the plurality of heel openings 353 and the plurality of arch protrusions 337 extending through the plurality of arch openings 354. If desired or necessary, the canting assembly (not shown) is attached to the plurality of heel protrusions 334 and the arch protrusions 337. The main object is the canting assembly is to change the plane of the foot bed, starting with a lift of the heel that has a gradual angle that tapers longitudinally downward toward the front outer side of the sole such that there is virtually no lift behind the first metatarsal.

With reference to the conventional three phases of a step, with a transition between each of the three phases, the foot bed 300 operates as follows. The heel strikes first while the plurality of heel protrusions 334 flex to stabilize against posterior foot bed frame assembly arch portion 332 distortion, the heel shape centers between body first region 315 and second region 316 of the heel portion 312. The firm first region 315 stabilizes against early pronation while the soft second region 316 flexes forming the heel roll zone.

As the foot moves toward the stance phase, the plurality of heel protrusions 334 slope downward to a void in the posterior of the foot bed frame assembly arch portion 332. The tuberosity at the base of the fifth metatarsal head suspends into a semi firm body third region 317 forming the pocket of the first foot bed suspension zone 320. The suspension is maintained by the posterior void by plurality of heel protrusions 334 and the anterior void of the foot bed frame assembly arch portion 332 camber. Camber is created in the foot bed frame assembly arch portion 332 from the void between the height and angle of the most lateral section of the plurality of heel protrusions 334 and the most lateral anterior level transverse plane of the foot bed frame assembly arch portion 332. As the lateral foot suspends into the first foot bed suspension zone 320, the head of the first metatarsal suspends into a medial pocket of the second foot bed suspension zone 321. The first metatarsal head is suspended because the plurality of heel protrusions 334 are angled forward with an alteration in depth between the protrusions. As pressure is placed upon the plurality of heel protrusions 334, the plurality of heel protrusions 334 move down and forward with a spring effect forming the second foot bed suspension zone 321. During the stance phase, the medial and lateral suspension zones position the frame for least resistance to multiple foot shapes, and the mid-foot is cradled as it falls along a large convex soft fourth region 318.

As the foot moves towards the toe off phase, the most anterior lateral protrusion of the plurality of heel protrusions 334 maintain lateral suspension in first foot bed suspension zone 320 while the camber in the anterior lateral section of the foot bed frame assembly arch portion 332 flexes downward. The downward pressure moves to transfer medially as the fifth region 319 and medial frame toe off lever 339 resist compression, the medial transfer moves center tabs of the medial mid section of anterior frame section, including the foot bed tabs 338, downward. This stabilizes the fold zone 307 between the anterior lateral frame section levers and the medial toe off lever 339. The materials of the anterior frame sections are semi rigid, rigid type materials of TPU, nylon type.

During the toe off phase, the medial portion of the plurality of heel protrusions 334 flex downward and angle forward, this supports the anterior section of the medial arch, while suspending the lateral section of the medial arch along a frame void adjacent to third foot bed suspension zone 322. The third foot bed suspension zone 322 allows the lateral arch to adjust the flexion of the soft body of second region 316 and semi firm body third region 317. The lateral arch suspension zone allows the foot to engage the toe off sequence without resistance to the natural path of the foot from the frames. At toe off, the first metatarsal head rolls forward on the second foot bed suspension zone 321, the zone is suspended between the engaged plurality of heel protrusions 334 and the anterior toe off lever 339. The first metatarsal head flexes the base of the fold zone toe off lever 339 to release all posterior frame compression for a stabilized and controlled toe off.

With reference to FIGS. 31-42, a fourth and simplest embodiment of the reactive upper sole, according to the present invention, will now be described. According to this embodiment, the reactive upper sole includes a foot bed 400 that is structured to be placed on top of a first frame assembly 40 and the second frame assembly for ward portion 53. The foot bed 400 is an insert that is structured to cooperate with the e.g., and mid sole and an outer sole (not shown). The characteristic features of the foot bed 400 may be changed by changing the materials used for manufacture of the foot bed 400 and altering the number and/or location of the various components.

The foot bed 400, according to this embodiment, which typically comprises an upper body, a foot bed frame assembly, and a foot bed composite all combined in all single upper body and frame assembly 410. The combined upper body and frame assembly 410 is generally shaped as an insole having a plurality of regions. The regions can be manufactured from different materials, or different compositions of a single material, so that each region has a specific resiliency. The combined upper body and frame assembly 410 has an upper surface 411 and a bottom surface. Some regions of the body may overlie other regions of the other components of the foot bed 400 as described below in further detail.

The combined upper body and frame assembly 410 includes a heel portion 412 and an arch portion 413. The foot bed 400 has an inner side and an outer side corresponding to the inner and outer sides of a human foot. The elongate side of the sole 1 that is structured to contact a user's big toe is referred to as the "inner" side of the sole 1, and the elongate side of the sole that is structured to contact the user's little toe is referred to as the "outer" side. A first region 415, located at the inner side of the foot bed heel portion 412, is manufactured from a firm material, such as EVA.

The combine upper body and frame assembly 410 forms the uppermost top layer which is located to contact and engage with the wearer's foot while a bottom surface of the combined upper body and frame assembly 410 engages with the outer sole. The main object of the sole of this embodiment is to provide a foot bed which has the greatest heel lift along the rear most area and inner side of the heel portion 412. The thickness of the foot bed 400 gradually tapers or feathers to a minimal thickness of about 0.5 mm at both the outer side of the heel portion 412 and the forward most outer side of the arch portion 413, adjacent the first metatarsal head, such that there is virtually no lift behind the first metatarsal.

With reference to the conventional three phases of a step, with a transition between each of the three phases, the foot bed 400 operates as follows. The heel strikes first while the heel portion 412 of the combined upper body and frame assembly 410 centers and stabilizes against early pronation and assists with heel roll zone as discussed above.

Figure 45:
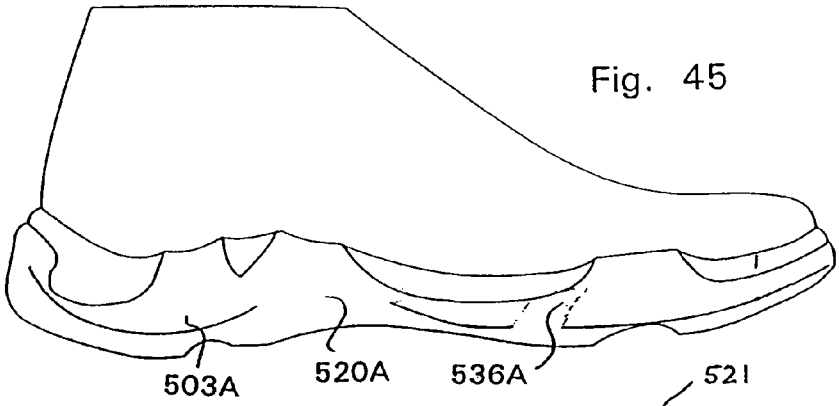
FIG. 45 is diagrammatic inner side elevation view of the fifth embodiment for the left foot.
Figure 43:
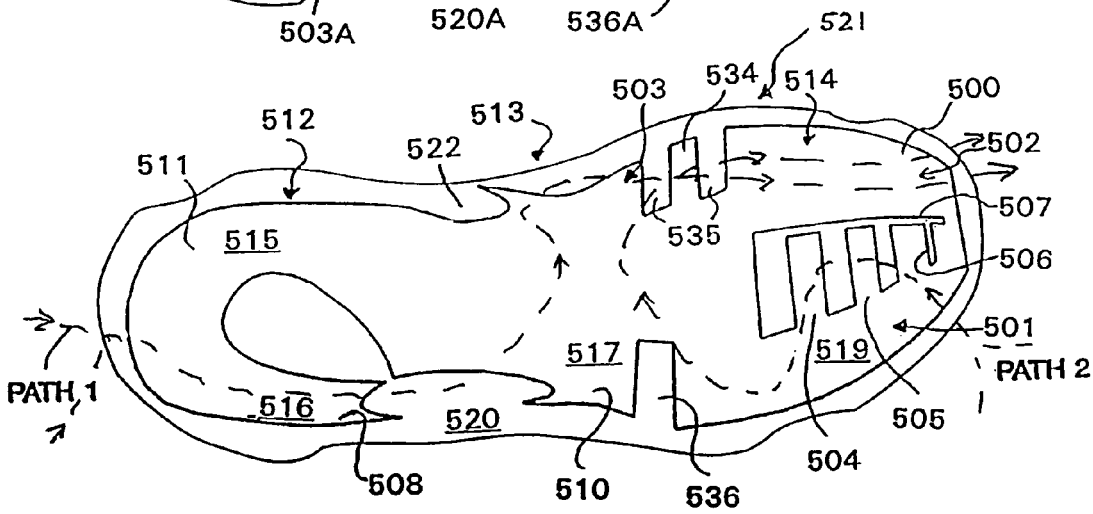
FIG. 43 is diagrammatic top plan view of a fifth embodiment for the sole assembly with the inner sole performing some of the structural characteristics of the mid sole.
Figure 44:
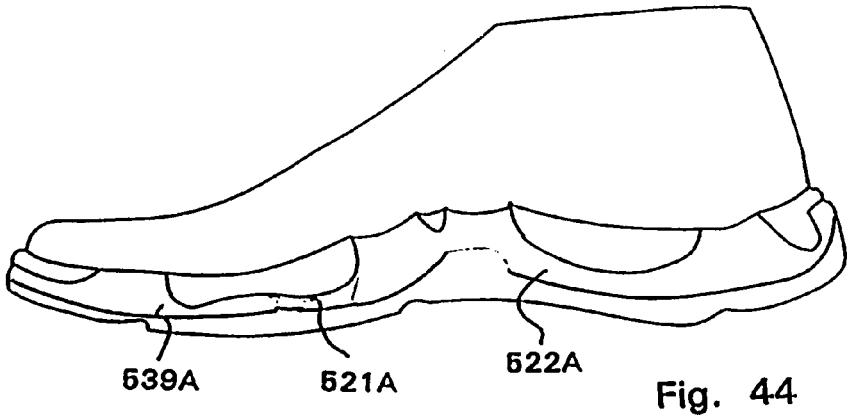
FIG. 44 is diagrammatic inner side elevation view of the fifth embodiment of FIG. 43 for a right foot.

With reference to FIGS. 43-45, a fifth embodiment of the reactive upper sole, according to the present invention will now be described. According to this embodiment, the reactive upper sole includes a foot bed 500 that is structured to function as the mid sole and may be used in combination with one or more frame assemblies as with the previous embodiments, e.g., the foot bed 50 may be placed on top of a first frame assembly and a second frame assembly forward portion. The foot bed 500 is an insert that is structured to cooperate with the outer sole. The characteristics features of the foot bed 500 may be changed by changing the materials used for manufacture of the foot bed 500 and altering the number and/or location of the various components.

The foot bed 500 includes a plurality of folding directional levers 501, 502, 503. The first lever 501 extends longitudinally on the outer side of the forward portion of the sole. The second lever 502 extends longitudinally on the inner side of the forward portion. The third levers 503 extend, generally, perpendicular to a longitudinal axis of the foot bed 500 at the arch portion 513. An upper body 510 links the folding directional levers 501, 502, 503 that help the foot control the shoe throughout the toe off phase. The fore foot engages a first anterior lateral directional lever 501 that alters in angle to move the medial lever tabs 504, 505, 506 at downward angles along front and rear weak zones forming a longitudinal medial fold zone 507 located approximately between the big toe and the second toe and extending longitudinally to the ball of the foot. This movement structures a medial directional lever 502 that extends longitudinally bordered by the guiding support of the fold zone. Posterior to the medial directional lever 502 and an anterior medial arch wrap directional lever 503 are levered by the plantar protrusions that alter in depth allowing the first metatarsal to move and angle the anterior metatarsal head along the suspension 521 (described below). This allows the posterior metatarsal and anterior toe to an uninterrupted off phase positioning. The downward lever action of the anterior medial arch moves and stabilizes the medial directional lever 502 upward as it supports the front of the medial arch in motion to the toe off phase. These folding directional levers 501, 502, 503 may extend the full length of the foot bed 500. These directional levers 501, 502, 503 cooperate with the directors in the second frame assembly. Thus, the user's foot activates levers in the foot bed 500 which act on the directors in the second frame assembly which, in turn, act on the outer sole 10.

The foot bed 500, according to this embodiment, includes a single layer, namely, the upper body 510 which has softer areas and more firmer areas. In some applications, the foot bed 500 may includes additional layers. It is to be appreciated that there may be less layers or the various layers may be combined with one anther to form an integral and unitary structure. The upper body 510 is generally shaped as an insole having a plurality of regions manufactured from different materials, or different compositions of a single material, so that each region has a specific resiliency. The upper body 510 has an upper surface 511 and a bottom surface. Some regions of the body may overlie other regions of the other components of the foot bed 500 as described either above or below in further detail.

The upper body 510 includes a heel portion 512, an arch portion 513, and a forward portion 514 (FIG. 3). The foot bed 500 has an inner side and an outer side corresponding to the inner and outer sides of a human foot. The elongate side of the sole 1 that is structured to contact a user's big toe is referred to as the "inner" side of the sole 1, and the elongate side of the sole that is structured to contact the user's little toe is referred to as the "outer" side. A first region 515, located at the inner side of the foot bed heel portion 512, is manufactured from a firm material. A second region 516, located at the outer side of foot bed heel portion 512, comprises a lever arm 508 which terminates at a remote free end 509 and is typically manufactured from the same material. The free end 509 of the lever arm 508, which is unattached to a remainder of the upper body 510, assists with downward flexing of the lever arm 508 toward the outer sole 10 when gaiting pressure from the foot is applied to the upper body 510 during heel strike and in essence renders this area "softer" then a remainder of the heel portion 512. A third region 517, extending from the heel portion 512 over the arch portion 513 along the inner side of the forward portion 514 and along the outer side of the sole, is manufactured firm material, such as EVA. A final region 519, located on the outer side of foot bed forward portion 514, is also manufactured firm material, such as EVA. The upper body 510, according to this embodiment, is provided with a plurality of relief areas to render certain areas of the upper body 510 less firm than a remainder of the upper body 510. The relief area accommodate a material, such as, which is more resilient than a remainder of the upper body 510.

A first foot bed suspension zone 520 is provided on the outer side of the foot bed arch portion 513. The first foot bed suspension zone 520 is first void provided in the third region 517, e.g., the first void is filled with a "more resilient" material to render this area softer than a remainder of the sole assembly. A second foot bed suspension zone 521, formed by a single piano key 534 extending from a remainder of the upper body 510, is located on the inner side between the foot bed arch portion 513 and the foot bed forward portion 514. A third foot bed suspension zone 522, is a smaller void located on the inner side, between the foot bed heel portion 512 and the foot bed arch portion 513, e.g., the second void is also filled with a "more resilient" material to render this area softer than a remainder of the sole assembly. The two opposed latter sides of the single piano key 534 are spaced from remainder of the upper body 510 by gaps 535 and the gaps 535 are filled with a softer material. The single piano key 534 and associated gaps 535 in the upper body 510 facilitate bending or flexing of the single piano key 534 downward toward the outer sole when walking pressure from the foot is applied to the upper body 510 to render this area softer than a remainder of the shoe sole. An outer side lateral edge, opposite to the single piano key 534, has a cut out or notch 536 formed therein, e.g., the cut out or notch is filled with a "more resilient" material to render this area softer than a remainder of the sole assembly. Each of the suspension zones tend to be softer areas than the remainder of the foot bed 500.

The foot bed 500 may possibly include a canting assembly (not shown), such as a pair of clips that are structured to change a heel lift plane. The two clips, once attached, combine with one another to form a plane that tapers to increase the spacing of the upper surface of the body heel portion 512 relative to remainder of the shoe sole. That is, the foot bed 500 is generally flat at the second suspension zone 521 and thicker at the inner side of the heel such that a taper between the heel and the second suspension zone 521, for the first metatarsal head, is between about 2 to 4 degrees.

The upper body 510 forms the uppermost top layer which is located to contact and engage with the wear's foot and is positioned over the outer sole (not shown). If desired or necessary, one or more conventional frames and/or a mid sole (only diagrammatically shown in FIGS. 43-54) may be located between the upper body 510 and the outer sole 10. In addition, a canting assembly, for changing a plane of the foot bed 500, starting with a lift of the heel that gradually tapers longitudinally downward toward the front outer side of the sole such that there is virtually no lift behind the first metatarsal, may be employed.

With reference to the conventional three phases of a step, with a transition between each of the three phases, the foot bed 500 operates as follows. The heel strikes just to the outside of center of the heel portion and this commences compression of the lever arm 508 and roll of the foot toward the outer side of the foot bed 500. The firm first region 515 stabilizes the foot against early pronation while of the lever arm 508 (i.e. the soft second region 516) flexes downward forming the heel roll zone.

As the foot moves toward the stance phase, the tuberosity of the base of the fifth metatarsal head suspends into a semi firm body third region 517 forming the pocket of the first foot bed suspension zone 520. Downward suspension of the fifth metatarsal tuberosity forces a lateral mid-section of the shoe sole, slightly medial of the fifth metatarsal head, to tilt downward toward the lower shoe sole and such tilting action torques and forces the opposite inner side of the arch portion 513, e.g., at the forward portion of the arch section 513 and the single piano key 534, to tilt upward away from the outer shoe sole. The single piano key 534 and the single cutout or notch 536 provide a pair of opposed relief areas which assist with torqueing of a central region of the foot bed 500 as the fifth metatarsal head suspends in the third region 517. As the lateral foot suspends into the first foot bed suspension zone 520, the head of the first metatarsal suspends into a medial pocket of the second foot bed suspension zone 521. During the stance phase, the medial and lateral suspension zones position the frame for least resistance to multiple foot shapes, and the mid-foot is cradled.

As the foot moves from the stance phase towards the toe off phase, the sole flexes and releases the downward pressure from the lever arm 508 and the release pressure flows toward inwardly toward the inner side of the sole and then forward toward the medial the second region 517 and a toe off lever 539, as depicted by path P1.

During such transision, the fifth metatarsal continues to flex further downward toward the outer sole 10 compressing posterior transverse director frame section, located beneath the fifth metatarsal, while an oppose anterior frame is biased upward away from the outer sole and torques inward, toward the outer side, along the fold zone 507 following a second transfer path P2. During this transfer phase, as the sole flexes, the posterior lateral frame torques both downward, toward the outer sole, and outward toward the outer side of the sole while an anterior lateral frame moving upward torques inward as the sole compresses. The inward torque transfer the foot's shoe control medially and the posterior medial frame, between the forward most region of the arch portion 513 and the single piano key 534, maintains an upward support or force as the posterior and lateral compresses downward toward the outer sole. The single piano key 534 and the medial posterior frame flex downward toward the outer sole as the anterior medial frame anterior compress inward.

During the toe off phase, all of the energy from paths P1 and P2, generate within the sole, are combined with one another and release from the shoe sole. As the foot moves forward, medially toward toe off, a void in the medial frame, beneath the third suspension zone 522, allows the foot to pronate between first and third suspension zones 520 and 522 with support from the frame section. The ball of the first metatarsal head pushes the second suspension zone 521 posterior frame downward with a constant upward support pressure from an anterior and the diving board 539 and any support structure or fame located beneath the diving board 539.

At toe off, the ball of the first metatarsal head rolls forward compressing the single piano key 534, and the frame located beneath the single piano key 534, and the diving board 539, and the frame located beneath diving board 539, releasing the posterior pressure on from the foot bed 500 for an energetic, stabilized and controlled toe off. Once this occurs, the foot bed 500 and the frame(s) supporting the foot bed 500, return to their original state for a subsequent heel strike.

Figure 48:
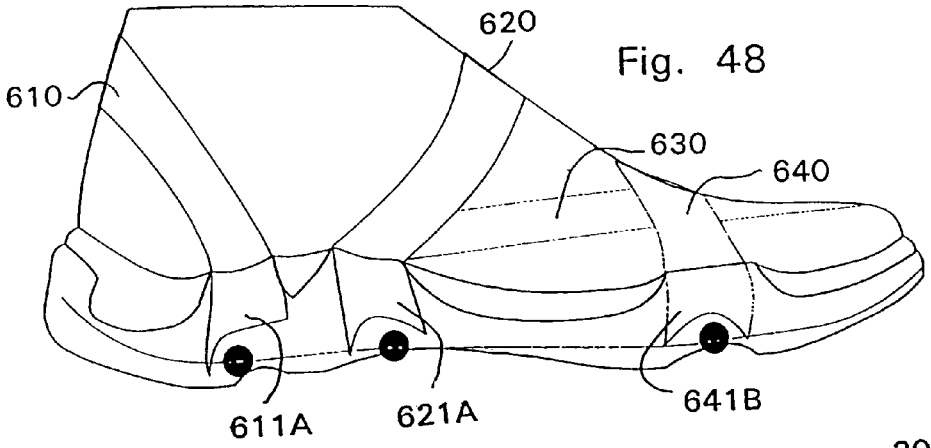
FIG. 48 is diagrammatic inner side elevation view of the sandal for the left foot.
Figure 46:
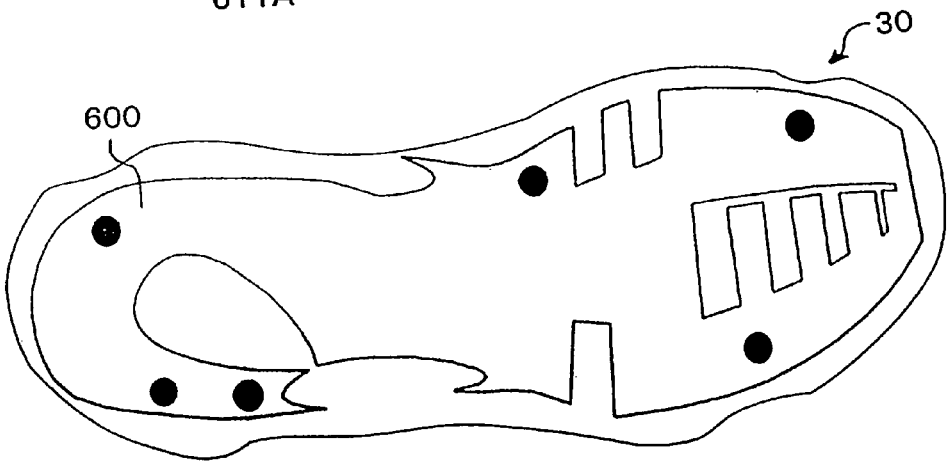
FIG. 46 is diagrammatic top plan view of a fifth embodiment with the inner sole performing some of the structural characteristics of the mid sole.
Figure 47:
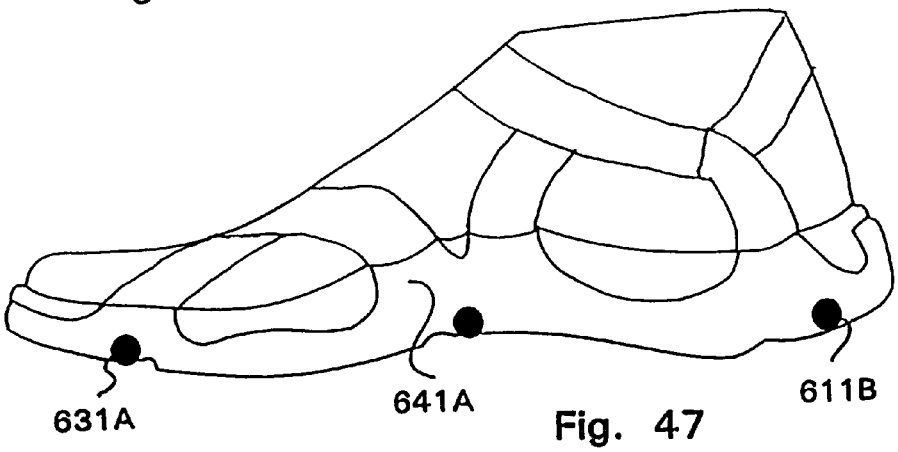
FIG. 47 is diagrammatic inner side elevation view of the sandal of FIG. 43 for the right foot.

As shown in FIGS. 46-48, the reactive upper sole assembly 30 and the foot bed 600 may be further enhanced when used as the sole of a shoe that moves selected zones of attached upper material, the display shows the concept as a sandal 600. The sandal 600 adds additional control functions which act through straps 610, 620, 630, 640 (only diagrammatically shown). The straps 610, 620, 630 and 640 interact with the wear's foot to control the reactive upper sole 30, the foot bed 600, and/or the outer sole assembly. The straps 610, 620, 630 and 640 also act as a positioning system, the straps position to border the plantar pockets formed by suspension zones, the straps 610, 620, 630 and 640 and material link to frame connection locations allowing structured side pockets and flex zones that align with the plantar pockets, flex and suspension zones. This forms a positioning pocket that forms to multiple foot strictures that need positioning of the shoes upper wall, as well as suspension positioning on its plantar base. That is, the wear's foot, which may have many different shapes, is moved to the proper position on the reactive upper sole 30 or foot bed 600. The positioning system includes a plurality of pockets and flex zones around the first metatarsal and the fifth metatarsal. These pockets and flex zones center the wear's foot on the reactive upper sole 30 or foot bed 600. Similarly, shoes can be programmed with upper lacing systems that pull fabric around the pocket suspension zone borders. The fabric attaches to the reactive sole assembly 30 at locations that move the fabric away from interference of foot positioning as the frame directors and flexors alternate the shoe upper by tightening and loosening zones during foot guidance during the gait cycle. The remote ends, of external fabrics or straps for a sandal, can be secured or connected to internal programmed moving structures of the shoe sole so that as the moving structures move toward or away from the outer sole, for example, as a result of the foot guiding the shoe sole during a gait or stride, the external fabric or strap moves in a corresponding upward or downward direction to either increase or decrease the securing tension that the external fabric or strap exerts on the foot.

As can be seen if FIGS. 46-48, the footbed of the fifth embodiment is incorporated into a sandal. The first strap 610 has a first end attached at 611A to an inner side of the heel portion and a second end extends around the rear portion of the heel of a user and is attached to an outer side (not shown) of the heel portion 612. A second strap 620 has a first end attached on the inner side at 621A of the heel portion 612, slightly forward of the first attachment point 611A. The strap 620 crosses over the front portion of the ankle and a second end thereof attached to the first strap 610 adjacent the attachment point of the first strap 610 to the outer side of the heel portion 612. A third strap 630 has a first end attached to the outer side of the forward portion 614 and a second end extends over the foot and is attached to the attachment location 621A for the second strap 620 adjacent inner side of the heel portion 612. A fourth strap 640 has a first end attached at 641A to an inner side of the sole and a second end extends over the foot and crosses the third strap 630. A second end of the fourth strap 640 is attached to the second strap 620 adjacent to the attachment point 621A of the second strap 620 to the inner side of the heel portion 612. By attaching the straps 610, 620, 630 and 640 to movable components of the footbed, mid sole and/or lower sole, the straps 610, 620, 630 and 640 can be suitably tightened or loosened, as necessary, as the foot guides the shoe sole to provide added comfort to the wearer of the sandals 600.

The sole assembly provides a basic structure for the foot to guide a shoe sole in such a way the reduces the internal and external shearing that can occur. The shearing can alter many things, including performance, comfort and the foot's natural ability to move along multiple paths. The present invention is directed a providing footwear which facilitates the foot following in natural gait path. That is, the present invention provides an improved sole assembly which can be enhanced by programming the sole structures to work with, and not against, the foot.

The mid sole can be structured with two guidance structures, one for the upper surface closest to the foot, and one for the lower surface closest to the outer sole. The foot can then move the upper mid sole sections that move the lower mid sole sections and the outer sole sections. This results in a bi-frame sole structure.

Figure 50:
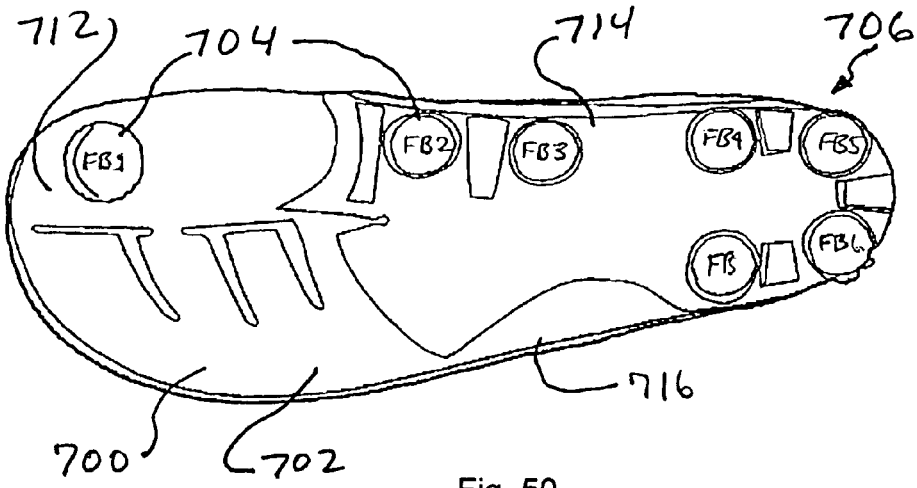
FIG. 50 is a diagrammatic bottom view of the foot bed of FIG. 49 equipped with a plurality of removal lugs on the undersurface thereof.
Figure 49:
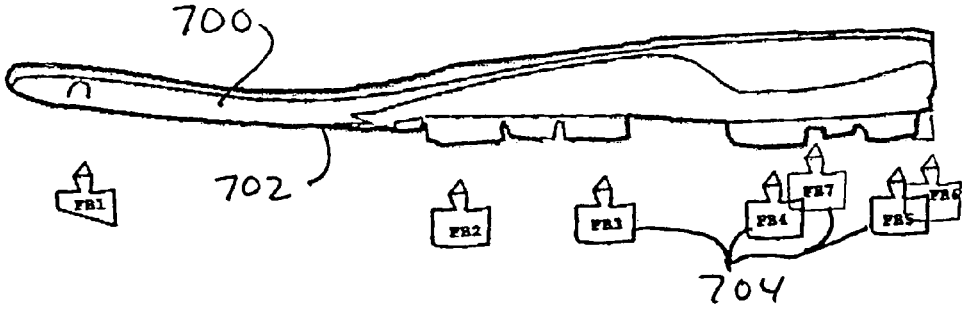
FIG. 49 is a diagrammatic side elevational view of a foot bed showing a plurality of removal cleats for attachment to an undersurface of the foot bed.
Figure 53:
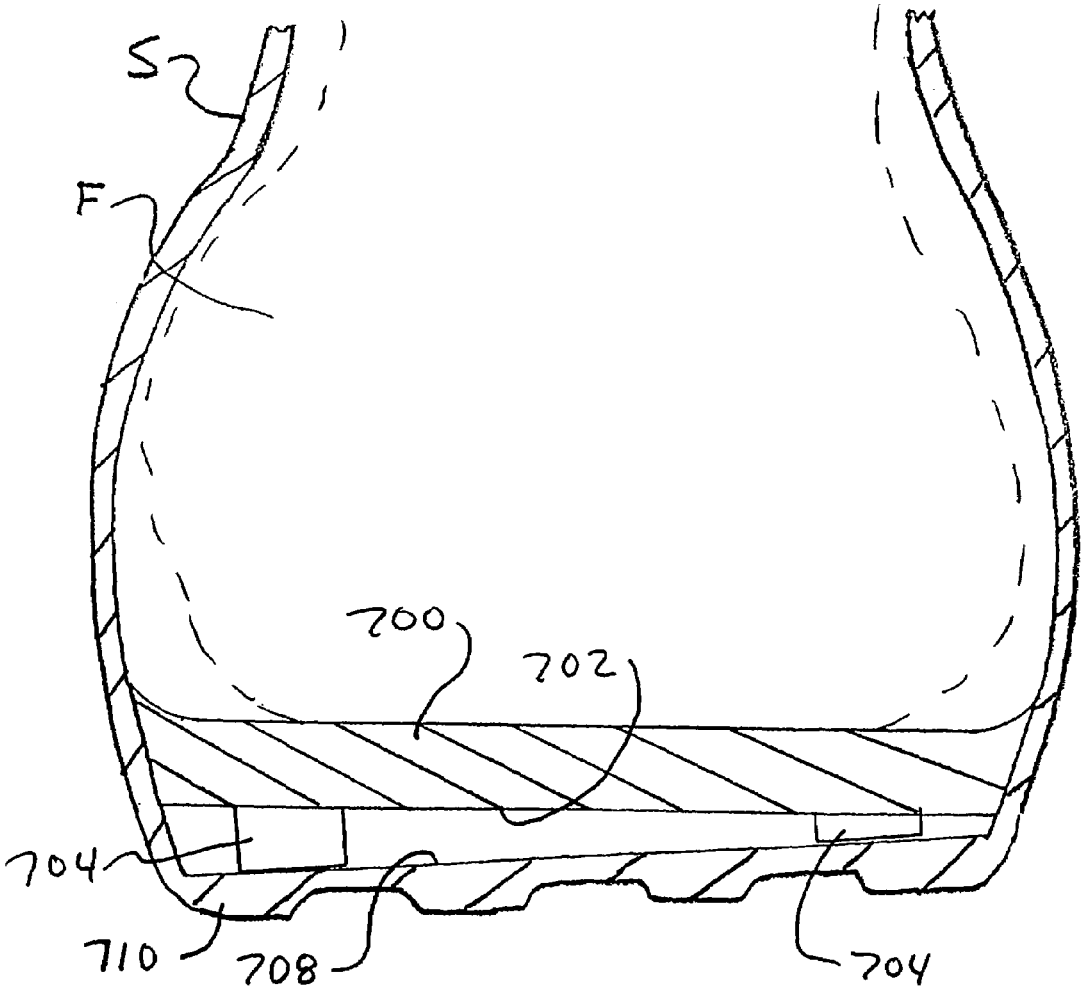
FIG. 53 is a diagrammatic cross sectional view of a shoe sole showing internal canting of the foot bed with respect to the exterior sole.
Figure 54:
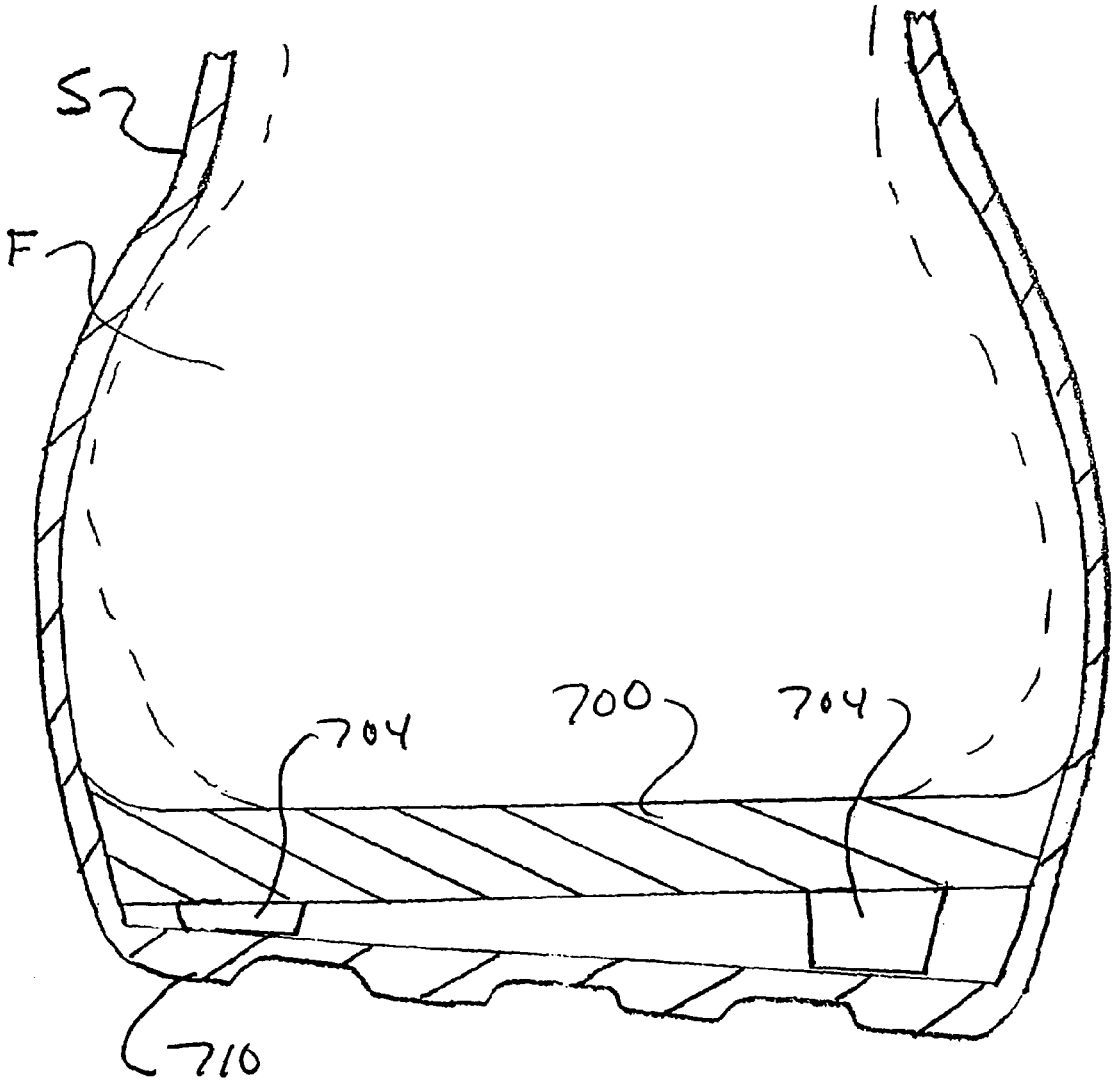
FIG. 54 is a diagrammatic cross sectional view of a shoe sole showing external canting of the foot bed with respect to the exterior sole.

It is to be appreciated that the undersurface 702 of the foot bed 700 can be provided with one or more strategically located, replaceable protrusions or lugs 704. As can be seen in FIG. 50, five lugs 704 are provided on the undersurface 702 along the longitudinal inside region of the foot bed 700 while two additional lugs 704 are provided along the longitudinal outside region of the foot bed 700, within the heel region 706 thereof. All of the lugs 704 are positioned to engage with a desired area of the upwardly facing surface 708 of the exterior sole 710 (see FIGS. 51 and 52). Each lug 704 facilitates spacing the undersurface 702 of the foot bed 700 a desired distance away from the upwardly facing surface 708 of the exterior sole 710, as can be seen in FIGS. 53 and 54, for example. By the use of the lugs 704, the spacing between the undersurface 702 of the foot bed 700 and the upwardly facing surface 708 of the exterior sole 710 can be varied, as necessary, from the toe region 712 to the longitudinal heel region 706 and vice versa and/or as well as along the longitudinal inside region 714 and the longitudinal outside region 716, and vice versa. A further description concerning the benefits of such spacing between the foot bed 700 and the exterior sole 710 will be provided below.

Figure 55:
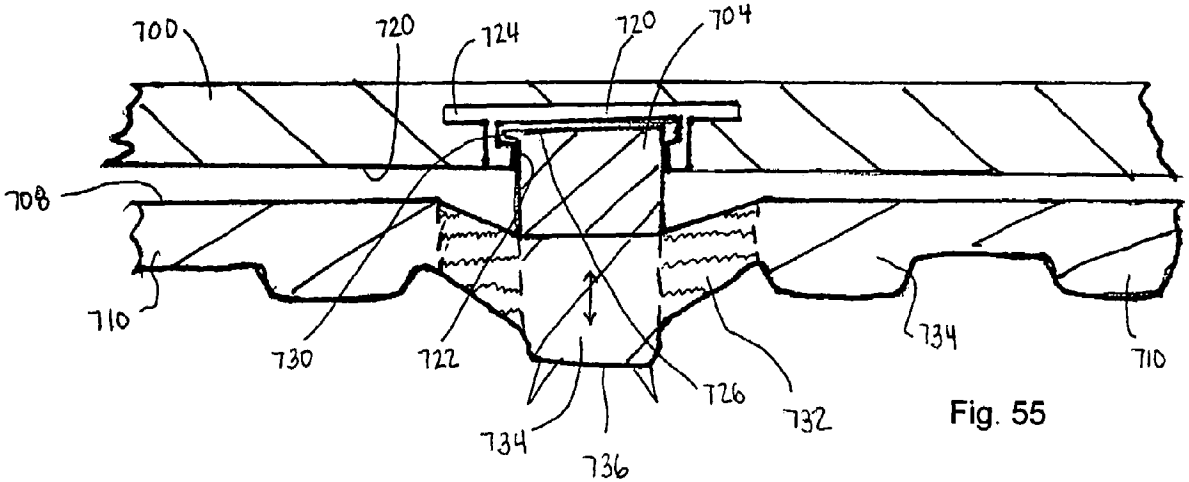
FIG. 55 is a diagrammatic cross sectional view of an exterior sole showing the extended position of the corresponding section by the corresponding lug to provide the desired gripping action by the exterior surface of the corresponding section.
Figure 56:
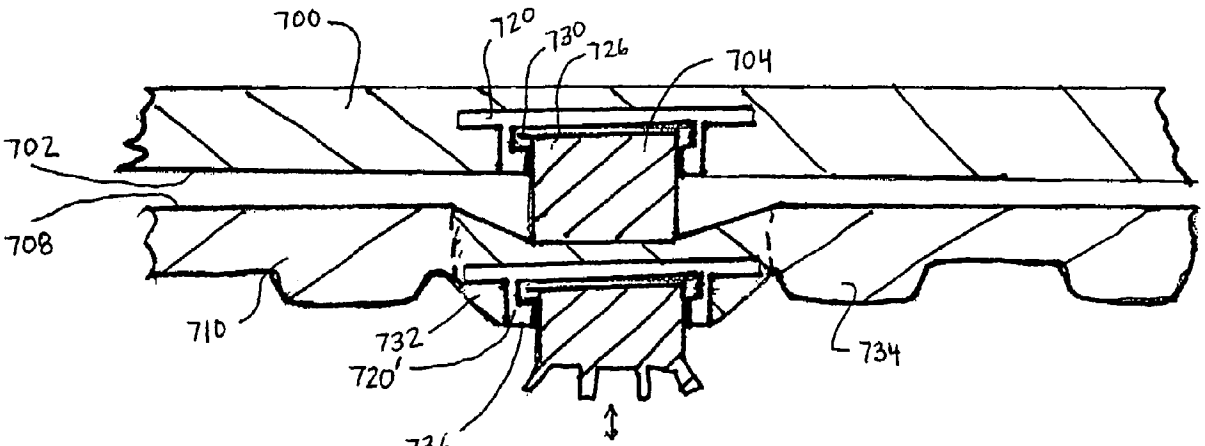
FIG. 56 is a diagrammatic cross sectional view of an exterior sole showing the extended position of the corresponding section by the corresponding lug to provide the desired gripping action by a replaceable component removably affixed to the exterior surface of the corresponding section.

Each lug 704 is preferably removably attached to the undersurface 702 of the foot bed 700 to facilitate quick and easy attachment thereto as well as facilitate changing or replacement of the lug 704 or possibly removal of the lug 704 altogether from the undersurface 702 of the foot bed 700 (see FIGS. 55 and 56). The quick release attachment of lugs according to U.S. Pat. No. 5,768,809 issued to Savoie on Jun. 23, 1998, for example, could be used to facilitate connection or disconnection of the lug 704 from a receptacle 720 molded or otherwise permanently embedded with the foot bed 700 and the teaching and disclosure of that patent is incorporated herein by reference.

According to the present invention, each receptacle 720 is initially molded or otherwise integrally formed with a remainder of the foot bed 700 such that an opening 722 leading, to the receptacle 720, faces the upper surface 708 of the exterior sole 710 and is exposed. A periphery or flange area 724 of the receptacle 720 is provided to facilitate securely molding or embedding the receptacle 720 within the foot bed 700. As such securement feature is conventional and well known, a further detailed discussion concerning the same is not provided. A mating leading portion of the lug 704 is provided with a head 726 which is sized and shaped to be received within the opening 722. The lug 704, once the head 726 is completely received within the opening 722, is then rotated relative to the receptacle 720, e.g., rotated relative to the receptacle 720 generally between 45 to 90 degrees or so, such that the peripheral locking members 730 of the lug 704, e.g., generally between one to eight locking members 730 and typically either three or four locking members 730, carried by the head 726 of the lug 704 engage with mating components (not labeled) located within the opening 722 of the receptacle 720 to securely attached the lug 704 to the receptacle 720 of the foot bed 700.

Although the above discussed receptacle/lug arrangement is one of the preferred embodiments, it is to be appreciated that a variety of other quick coupling/decoupling or quick connect/disconnect mechanisms or systems which are conventional and/or well known in the art could also be utilized. For example, a mating male and female thread arrangement could be employed, an interference snap fit between the opening 722 and the head 726 could be employed, etc., without departing from the spirit and scope of the present invention.

By appropriate selection of the number, shape, size, diameter, height and/or location of the removable lugs 704, releasably secured to the undersurface 702 of the foot bed, various modifications to the stance, posture, gait, stride, etc., of a user can be readily achieved. By suitable positioning of a desired sized and shape protrusion or lug 704, the spacing between the undersurface 702 of the foot bed 700 and an upwardly facing surface 708 of the exterior sole 710 can be readily altered, and thus the stance, posture, gait, stride, etc. of a user of the foot bed 700 equipped with one or more lugs 704 can be easily modified. That is, one or more protrusion(s) or lug(s) 704 can be used to compensate for an abnormal gate of an individual.

For example, a user who has the tendency to walk bow-legged can have a plurality of desired larger sized lugs 704 spaced along the longitudinal outer region 716 of the foot bed 700 (see FIG. 54). Such positioning of the plurality of larger lugs 704 causes the outside of the foot F of a user to be elevated with respect to the inside foot F and tends to move the knee, associated with that foot F, inwardly towards the opposite knee and centering the altered knee directly over the corresponding foot F. As a result of such external canting action of the foot bed 700, the knee of the user may be brought directly over the corresponding foot F of the user and this facilitates correction and/or compensation for an abnormal stance and/or gait of a bow-legged individual.

Alternatively, an individual who walks on the inside of his/her foot F, for example, can have one or more larger lugs 704 provided along the inside longitudinal region 714 of the foot bed 700 (see FIG. 53). Such placement of the plurality of larger lugs 704 causes the inside of the foot F of a user to be elevated, with respect to the outside of the foot F, and tends to move the knee, associated with that foot F, outwardly away from the opposite knee and thus center the altered knee directly over the corresponding foot F. As a result of such action, the altered knee of the user may be brought directly over the corresponding foot F of the user and this facilitates correction and/or compensation for an abnormal gait of an individual who walks on the inside of his/her foot F.

To facilitate rearward leaning of an individual, one or more larger lugs 704 can be provided along the leading or toe region 712 of the foot bed 700. Such placement of the one or more larger lugs 704 causes the toe area of the foot F of a user to be elevated with respect to the heel region 706 of the foot F and tends to move the knee, associated with that foot F, slightly rearwardly and center the knee directly over the corresponding foot F. As a result of such action, the knee of the user may be brought directly over the corresponding foot F of the user and this facilitates correction and/or compensation for another abnormal gait of an individual.

One or more larger lugs 704 can be provided along the trailing or heel region 706 of the foot bed 700 to facilitate forward leaning of an individual. Such placement of the one or more larger lugs 704 causes the heel region 706 of the foot F of a user to be elevated with respect to the toe portion of the foot F and tends to move the knee, associated with that foot F, forward and center the knee directly over the corresponding foot F. As a result of such action, the knee of the user may be brought directly over the corresponding foot F of the user and this facilitates correction and/or compensation for a further abnormal gait of an individual.

It is to be appreciated that positioning a desired number of suitably sized and shaped lugs 704 at desired locations along the undersurface 702 of the foot bed 700 can be use to space the undersurface 702 of the foot bed 700 a desired distance away from the upwardly facing surface 708 of the exterior sole 710. Such spacing of the undersurface 702 of the foot bed 700 from the upwardly facing surface 708 of the exterior sole 710 can compensate for virtually any abnormality in a human stance, walk, stride, gait, etc.

In a further variation, one or more protrusions or lugs 704 many be provided or located to interact with the exterior sole 710 to provide a desired action, e.g., a forward gripping action, a traction action, a lateral gripping action, a stopping action, etc., to the exterior sole 710. The degree of the desired action can be readily controlled by the height, size, shape, profile, type of material and/or location of the protrusion or lug 704 supported by the undersurface 702 of the foot bed 700 as well as the height, size, shape, profile and/or location of the exterior terrain engaging surface 736 of the exterior sole or possibly the height, size, shape, profile, configuration of a component 738, e.g., a spike or cleat, carried by the bottom terrain engaging surface 736 of the exterior sole 710.

To achieve the desired action, the exterior sole 710 is manufactured to have varying degrees of rigidity or hardness. For example, the exterior sole 710 has at least one corresponding flexible sole area 732 formed therein which is relatively flexible in comparison to a remainder 734 of the exterior sole 710. Each such corresponding flexible sole area 732 is typical manufactured from a softer material than the remainder of the exterior sole 710 to provide the corresponding flexible sole area 732 with the desired flexibility so as to allow the exterior bottom downwardly facing surface of the exterior sole 710 to be extended and retracted, as necessary, relative to the remainder of the exterior sole 710 to provide the desired gripping, traction and stopping, etc., action. Preferably the relatively more rigid area of the exterior sole 710 is manufactured from a relatively more rigid material such as plastic, nylon, TPU, TPR or composite while the relatively more flexible area of the exterior sole 710 is manufactured from a relatively softer material such as EVA, urethane, rubber or elastomer, for example.

With the lugs 704 supported by the undersurface 702 of the foot bed 700 so as to overlie a mating corresponding flexible sole area 732, when a user places his/her weight on the foot bed 700, this causes the foot bed 700 to exert a downward force and this downward force is transferred through the foot bed 700 to the corresponding lug 704. The force is then transferred from the lug 704 to the corresponding flexible sole area 732 formed in the exterior sole 710. The force exerted by the lug 704 to the corresponding flexible sole area 732 causes the exterior terrain engaging surface 736, of the corresponding flexible sole area 732, to be extended somewhat relative to a remainder of the bottom surface of the exterior sole 710 (see FIGS. 55 and 56). The exterior terrain engaging surface 736 of the corresponding flexible sole area 732 is equipped with a desired shape, profile, contour, etc., which will engage the terrain upon which the shoe S is traveling to provide the desired gripping, stopping, traction, etc., action of the exterior sole 710.

As can be seen in FIGS. 49-52, the front most lug 704 as well as the four rear most lugs 704 are located to engage with a cooperating surface of the bottom exterior sole 710 to provide a desired action to the sole 710, e.g., gripping, traction, lateral gripping, stopping, etc., the desired action of the sole 710 can be easily controlled by the shape, contour, height, type of material and other dimensions of the lugs 704 which engage with the cooperating flexible sole area 732 of the sole 710. Due to this arrangement, as the user places his/her weight on the foot bed, this causes the foot bed 700 to exert a downward force and this downward force is transferred through the foot bed 700 to the corresponding lug 704. The force is then transferred from the lug 704 to the corresponding flexible sole area 732 of the exterior sole 710. The force exerted by the lug 704 to the cooperating flexible sole area 732 and causes the exterior surface, of the corresponding flexible sole area 732, to be extended somewhat relative to a remainder of the bottom surface of the exterior sole 710. The bottom surface of the corresponding flexible sole area 732 is equipped with a desired shape, profile, contour, etc., which will engage the terrain upon which the shoe S will travel, to provide the desired gripping, stopping, traction, etc., action of the sole 710.

As each corresponding flexible sole area 732 is typically manufactured from a softer material than the remainder of the exterior sole 710, this provides the corresponding flexible sole area 732 with the desired flexibility so as to allow the exterior bottom outwardly facing surface of the exterior sole 710 to be extended and retracted, as necessary, to provide the desired gripping, traction and stopping, etc., action.

One particular application of the above described embodiment is for use in a golf shoe application. The exterior terrain engaging surface 736 of each of the corresponding flexible sole areas 732 can be provided with a conventional retaining member 720' which receives a desired spike or cleat 738. The foot bed 700 is provided with a respective protrusion or lug 704 for cooperating with each of the corresponding flexible sole areas 732. Due to this arrangement, as a golfer wearing the golf shoe takes a golf swing or otherwise undertaking a golfing activity, the weight of the golfer on the foot bed 700 causes the protrusion or lug 704 to be forced into the corresponding flexible sole area 732. The downward motion of the corresponding protrusion or lug 704 into the corresponding flexible sole area 732 causes the corresponding flexible sole area 732 to be extended relative to the remainder of the exterior sole 710 of the golf shoe. The extension of the corresponding flexible sole area 732 also simultaneously extends the supported spike or cleat 738 which grips or bites into the grass or other terrain upon which the golfer is playing. Thus, the improved foot bed 700 and exterior sole 710 arrangement of the present invention provides increased gripping action relative to the prior art golf shoe designs.

It is to be appreciated that the degree of gripping or biting action of the spike or cleat can be readily controlled by the user. For example, if a lesser degree of gripping or biting action by the spike or cleat is desired, the user can remove the foot bed 700 from the exterior sole 710 and replace desired ones of the protrusion(s) or lug(s) 704 with other smaller suitably sized, shaped, configured, etc., protrusion(s) or lug (s) 704 and thereafter reinsert the foot bed 700 back into the golf shoe. As a result of this alteration, the replaced protrusion (s) or lug(s) 704 will exert less force or pressure on the corresponding flexible sole area(s) 732, when the golfer's weight is applied thereto, so that the corresponding flexible sole area 732 will be extended by a lesser extent relative to the remainder of the exterior sole 710. The support spike or cleat 738 will, in turn, also be extended by a lesser extent and provide a lesser degree of gripping or biting action into the grass or other terrain.

Alternatively, if a greater degree of gripping or biting action of the spike or cleat is desired, the user can remove the foot bed 700 from the exterior sole 710 and replace desired ones of the protrusion(s) or lug(s) 704 with other larger suitably sized, shaped, configured, etc., protrusion(s) or lug(s) 704 and thereafter reinsert the foot bed 700 back into the golf shoe. As a result of this alteration, the replaced protrusion(s) or lug(s) 704 will exert increased force or pressure on the corresponding flexible sole area(s) 732, when the golfer's weight is applied thereto, so that the corresponding flexible sole area 732 will be extended by a greater extent relative to the remainder of the exterior sole 710. The support spike or cleat 738 will, in turn, also be extended by a greater extent and provide an increased degree of gripping or biting action into the grass or other terrain.

In addition, if the user were to remove the foot bed 700 from the exterior sole 710 and remove all of the corresponding protrusion(s) or lug(s) 704 from the undersurface 702 of the foot bed, and then reinsert the foot bed 700 back into the shoe S, the extending action of the corresponding flexible sole areas 732 can be interrupted. That is, once all of the corresponding protrusions and/or lugs 704 removed and when the golfer's weight is applied to the foot bed 700, the corresponding flexible sole areas 732 will not be extended by the corresponding protrusion(s) and/or lug(s) 704 relative to the remainder of the exterior sole 710. As a result of this, the supported spike or cleat will also not be extended and provide any gripping or biting action into the grass or other terrain.

Figure 57:
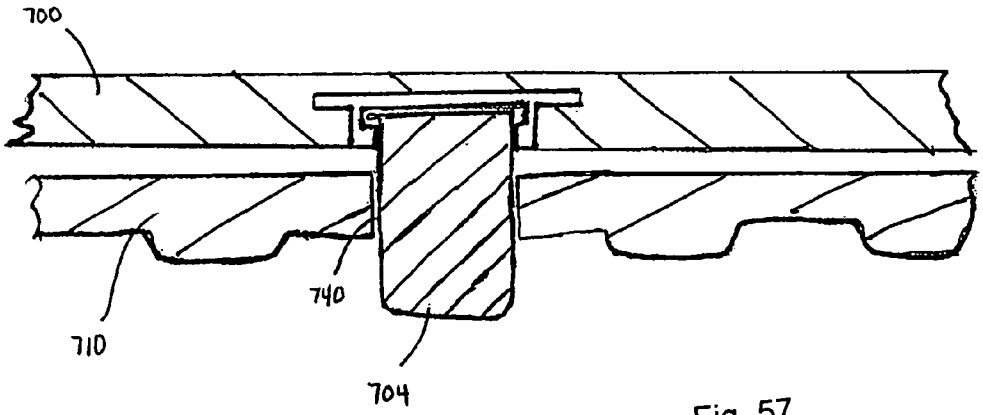
FIG. 57 is a diagrammatic cross sectional view of an exterior sole showing an elongated lug passing through a void, provided in the exterior sole, so that the lug directly provides the desired gripping action.

FIG. 57 show a diagrammatic cross sectional view of an exterior sole having an elongated lug 704, supported by the foot bed 700, passing through a void 740 provided in the exterior sole 710, so that the lug 704 directly provides the desired gripping action for the shoe.

It is to be appreciated that the number and location of the lugs 704 can be varied as necessary depending upon the particular application.

Further and Alternate Embodiments

Figure 58:
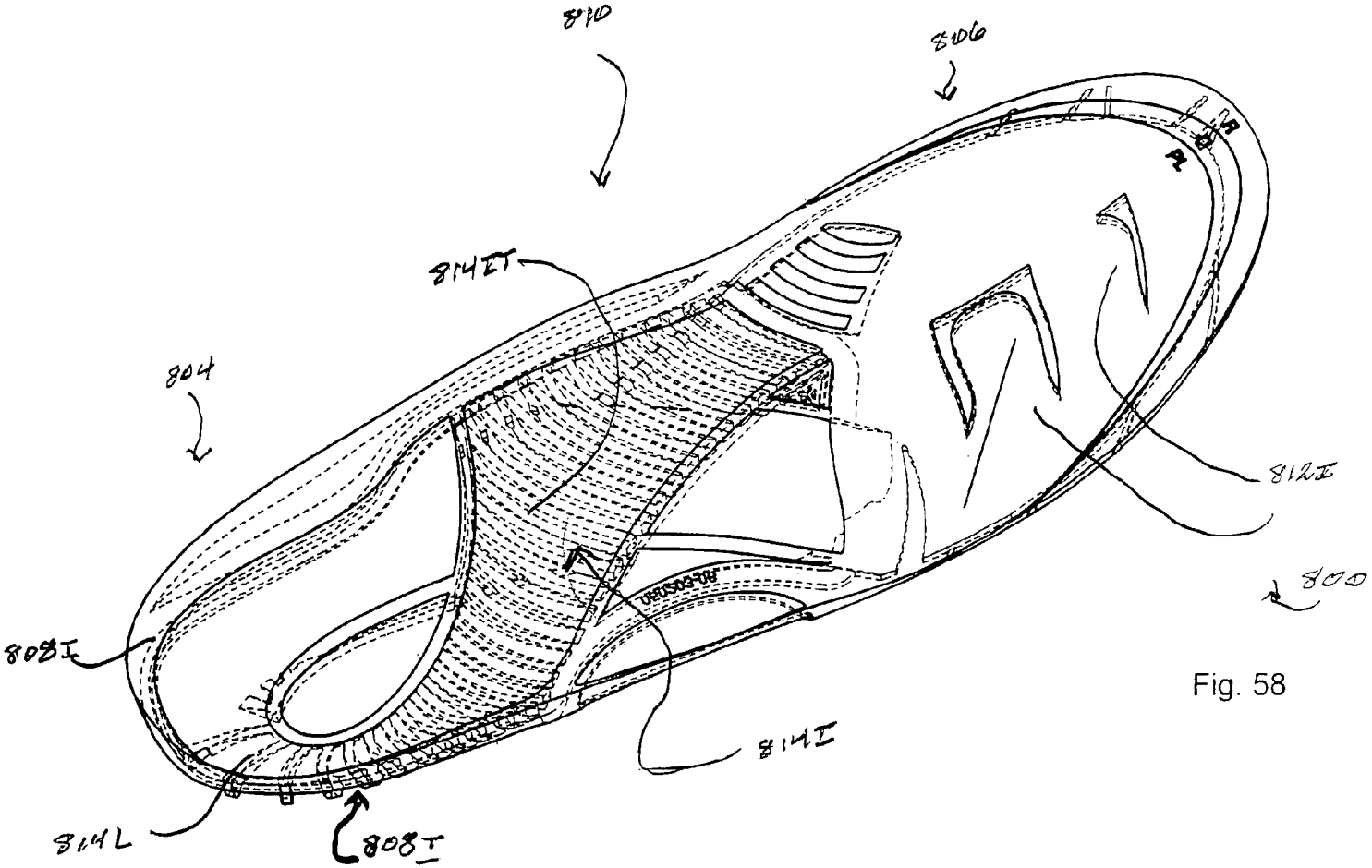
FIGS. 58, 59 and 60 are respectively a top view of an inner sole, a bottom view of an inner sole and a top view of a mating mid-sole.
Figure 59:
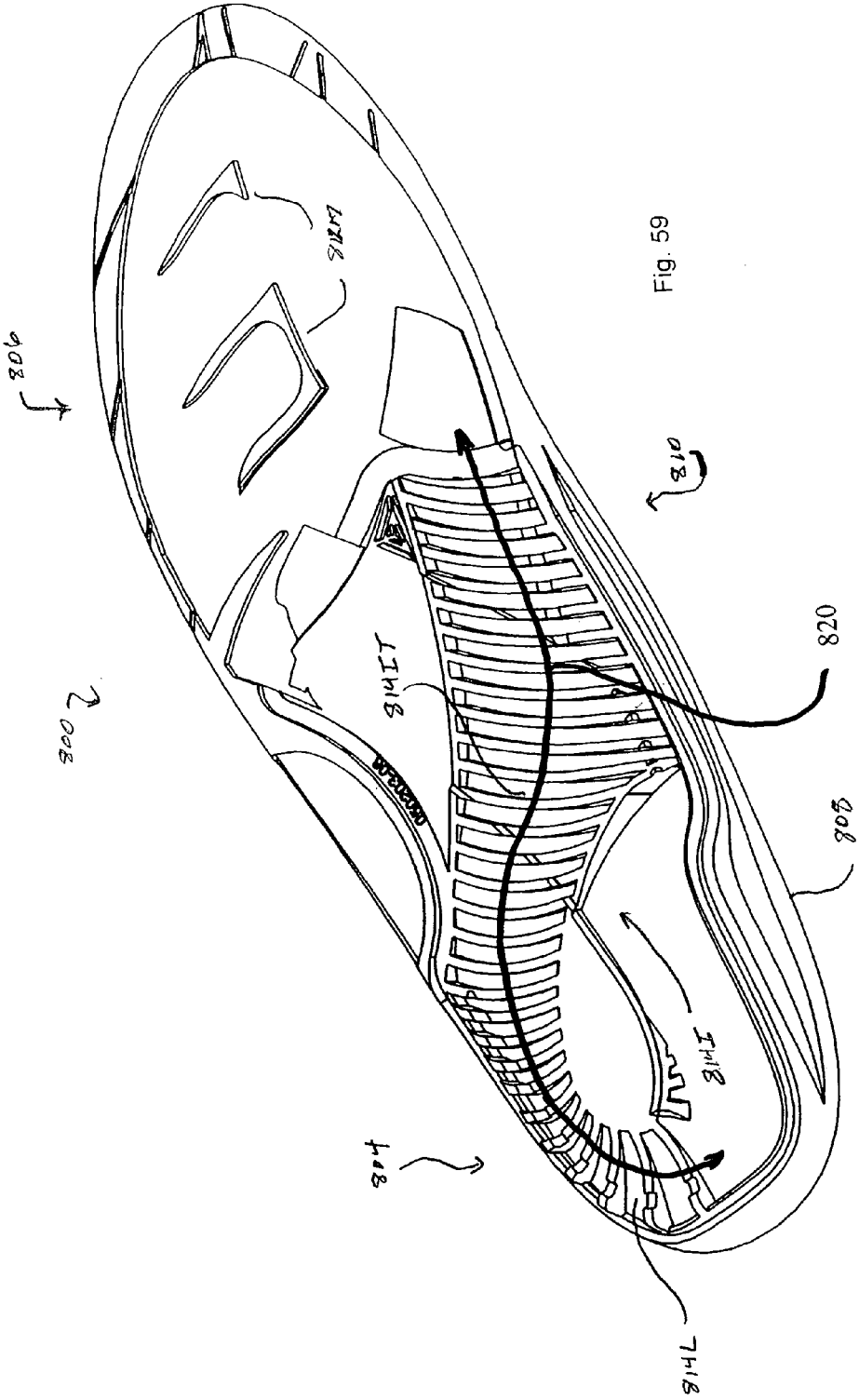
Figure 60:
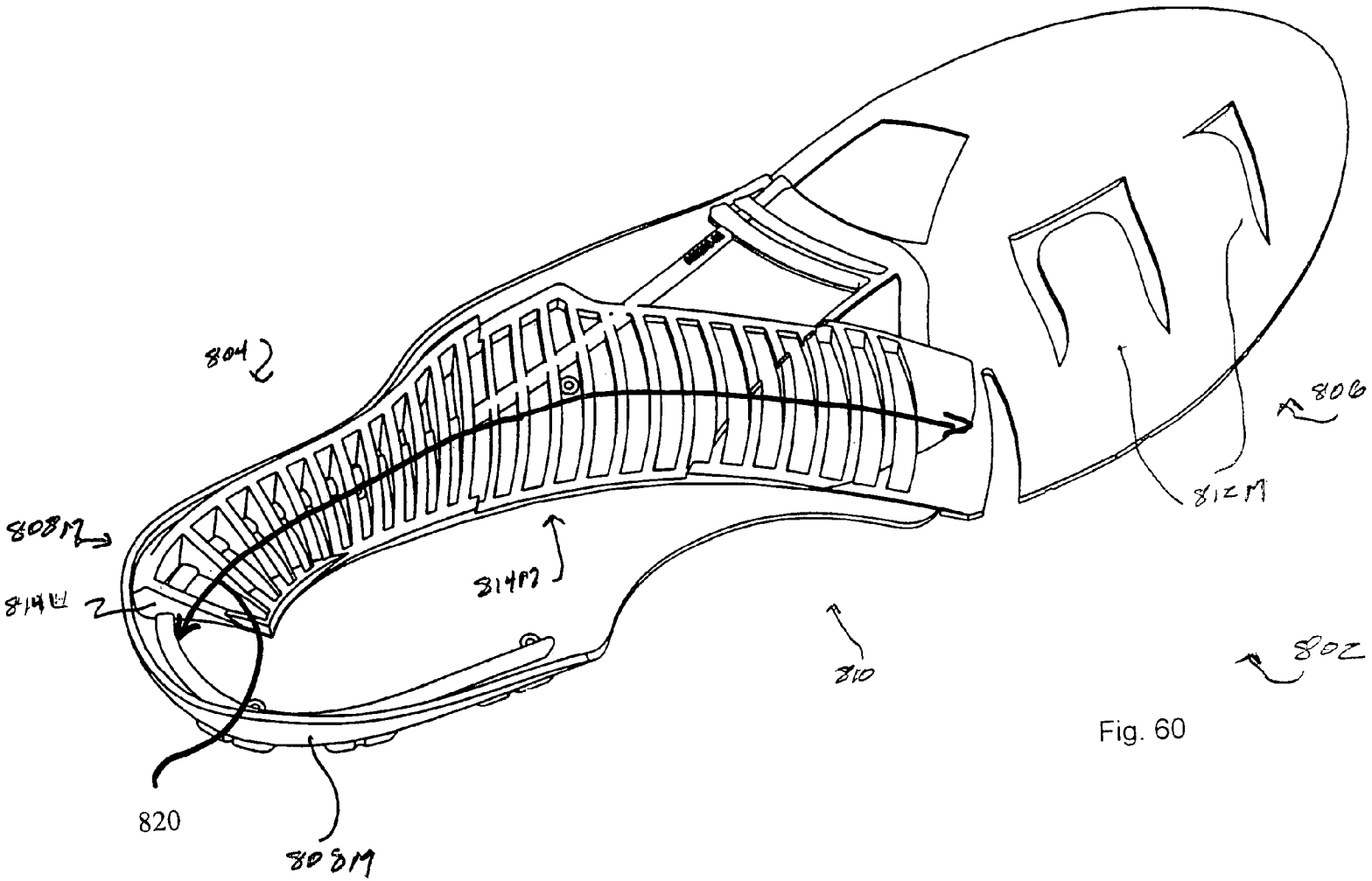

Referring now to FIGS. 58, 59 and 60, therein are illustrated an improved implementation of the above described invention wherein the improved embodiment offers light weight, improved performance, and increased flexibility in terms of being adapted to specific purposes or types of footwear and even to the needs and physical characteristics of individual users. FIGS. 58, 59 and 60 illustrate the invention for the right foot and respectively shown a top view of an inner sole, a bottom view of an inner sole and a top view of a mating mid-sole. It should be noted that a view of the inner and mid-soles as assembled is not shown due to the complexity of the resulting image, supplemental partial views of the soles being used instead where further illustration would be beneficial. It should also be noted that, in order to avoid confusion with the description and drawings of the implementation of the invention described previously herein, the reference numbers employed in the following will begin at reference number 800 and will proceed upwards from there.

It has been described herein above that a primary function and purpose of a sole structure of the present invention is to dynamically direct and distribute the interacting forces between the user's foot, the inner structures of the shoe and the ground during the motion and shifting of the user's weight and body structure, particularly the foot structures, when walking, striding, running or engaging in other activities. The embodiments shown and discussed herein above with regard to FIGS. 1-57 describe the fundamental principles and shoe structures for achieving these objects and are thereby incorporated into the following descriptions as regards the fundamental principles and structures of the present invention, as well as certain details of the shoe sole structures that are retained from those implementations to the following described implementations.

Referring therefore to FIGS. 58 and 59, the present invention is directed to the structures and resulting interactions of an inner sole 800 and a mid-sole 802 wherein inner sole 800 is located adjacent to the user's foot and mid-sole 802 is located between the inner sole 800 and an outer sole such as described previously herein above.

First considering inner sole 800, inner sole 800 is in the present embodiment implemented as a single piece structure of relatively resilient material that is generally shaped to the sole of the foot, the structure of inner sole 800 being relatively thicker in the heel region 804 and relatively thinner in the ball/toe region 806 with the circumferential edges of heel region 804 being extended upwards along the outside edge of the heel to form heel/side support 808I extending generally around heel region 804 and along both sides of the foot to generally the arch region 810 of the foot. As described herein above, heel support 808I is provided to control relative movement and rotation between the user's heel and the structure of inner sole 800.

As also indicated and has been described herein above, certain areas within ball/toe region 806 are contoured to form inner sole engagement structure 812I engaging with corresponding mid-sole engagement structures 812M of mid-sole 802 to prevent slippage between inner sole 800 and mid-sole 802.

Other features of inner sole 800 will be described in the following.

Referring therefore to mid-sole 802, mid-sole 802 is of the same general shape as inner sole 800 and includes, for example, a heel-side support 808M that mates and functions with the corresponding heel/side support 808I of inner sole 800 for the same purposes and functions. In addition, mid-sole 802 includes mid-sole engagement structures 812M that engage with the corresponding inner sole engagement structures 812I to retain mid-sole 802 and inner sole 800 in the desired relationship.

It should be noted, however, that mid-sole 802 differs from inner sole 800 in the mid-sole 802 is fabricated of a relative hard and non-resilient material in and extending from heel region 804 through arch region 810, the relatively rigid portion of the structure ending in the region behind the ball/toe region 806 of the foot. The region of mid-sole 802 extending from the relatively rigid portion, that is from about the forward end of the arch region 810, and forward to include all of ball/toe region 806 is fabricated of a relatively non-resilient but flexible material as has been described previously herein.

Therefore referring to the inner sole 800 and mid-sole 802 structures for dynamically directs and distributing the interacting forces between the user's foot, the inner structures of the shoe and the ground, inner sole 800 and mid-sole 802, or the assembly thereof, include a force direction structure 814 that will be described in detail in the following. As illustrated in FIGS. 58, 59 and 60, a presently preferred embodiment illustrated in FIGS. 58, 59 and 60, includes a force direction structure 814I that is associated with or part of inner sole 800 and a force direction structure 814M that is associated with mid-sole 802 wherein the force directions structures 814I and 814M engage and cooperate with one another to form the force direction structure 814.

Figure 62:
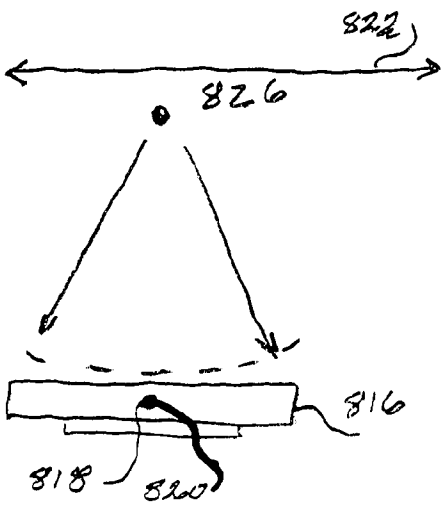
FIGS. 61 and 62 illustrate the bending and flexing of a rib ribbon about axes transverse to and parallel to a spine axis of the rib ribbon; and, FIG. 63 illustrates the directed transfer of forces by a rib ribbon in a ribbon loop configuration during a stride.
Figure 61:
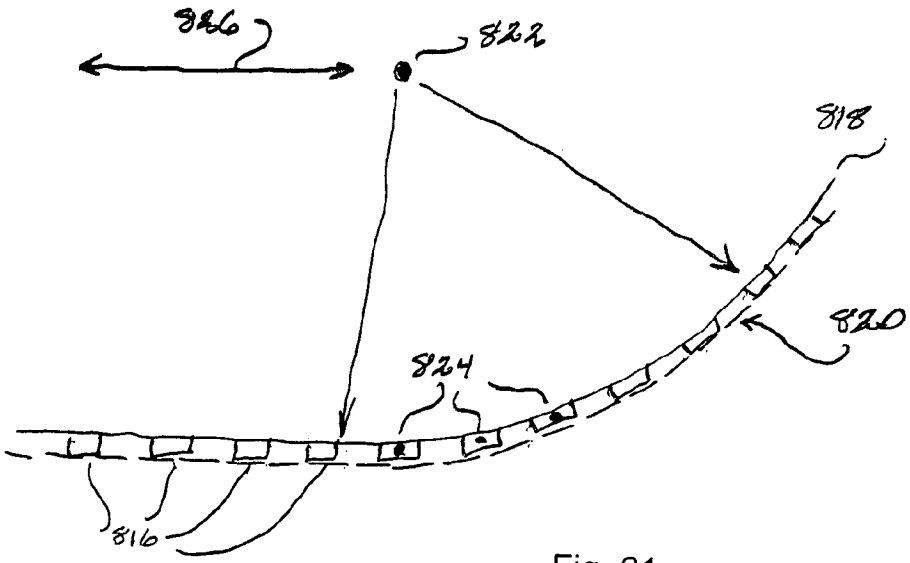
Figure 63:
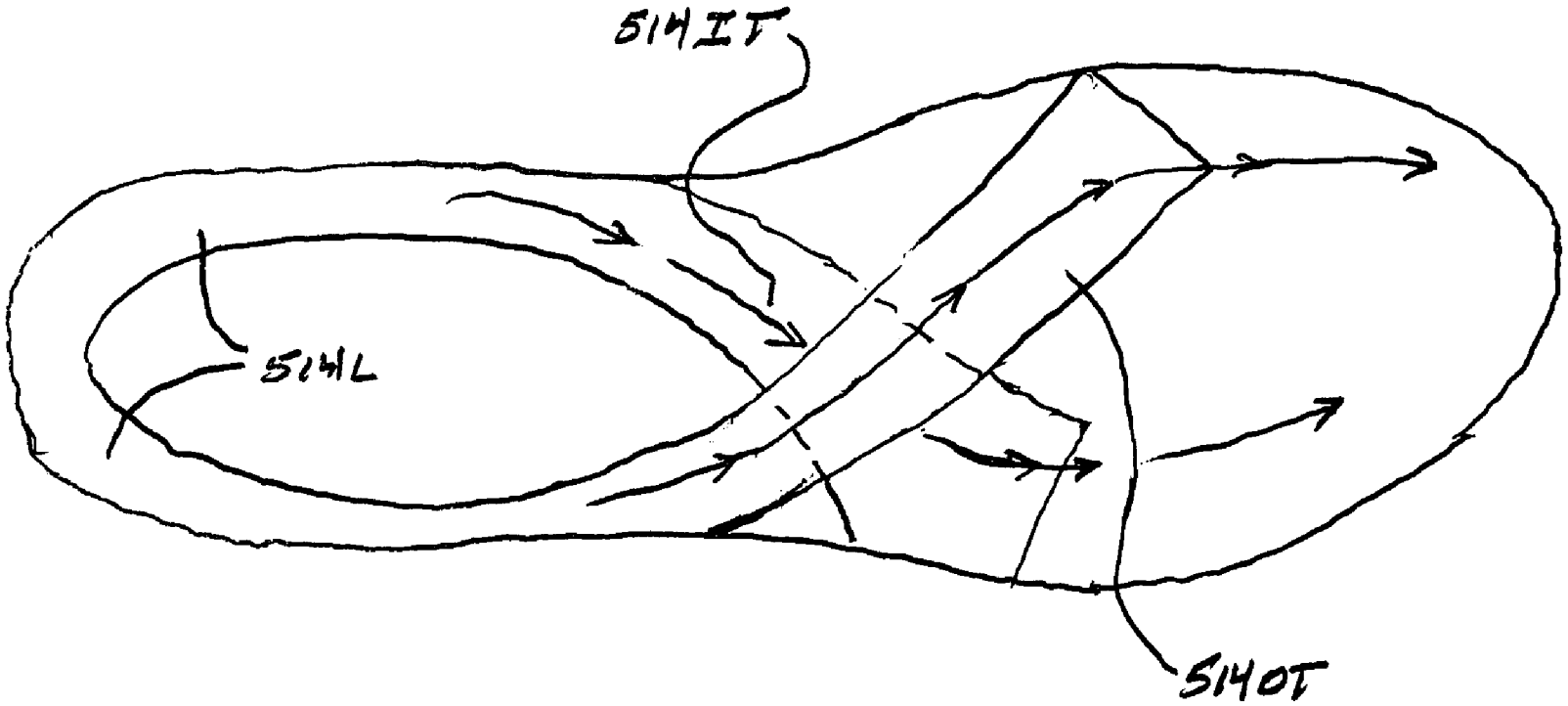

As illustrated in FIGS. 58, 59 and 60, and as illustrated in diagrammatic form in FIGS. 61 and 62, a force direction structure 814 is a ribbon-like structure comprised of a sequence of ribs 816 distributed along and transversely to a spine 818 that defines a spine axis 820. In this regard, it should be noted that in the presently preferred embodiment spine axis 820 is represented by the center points of ribs 816 and the function of spine 818, that is, retaining ribs 816 in a specific relationship with respect to one another, is performed by the inner sole 800 or mid-sole 802 surface that the ribs 816 are part of or to which the ribs 816 are attached.

As illustrated in FIG. 61, the arrangement of a segment of a force direction structure 814 as a series of ribs 816 distributed along and transverse to a spine 818 results in a structure that may be flexed or bowed about any transverse axis 822, that is, about any axis that is generally transverse to spine axis 818, or, stated another way, is generally parallel to the rib axis 824 of any rib 816. It will be recognized, in this regard, that the degree and extent of flex or bow about a spine axis 818, or transverse to spine axis 818, and the force required to achieve a flexing or bowing, will dependent upon such factors as the spacing, height, width, cross sectional shape and material of the ribs 816 and the flexibility and resilience of the spine 818, that is, and in the presently preferred embodiment, the flexibility and resilience of the inner sole 800 or mid-sole 802 material comprising the spine 818.

As illustrated in FIG. 62, however, a force direction structure 814 is relatively rigid and will resist bending or bowing about any longitudinal axis 826 that is generally transverse to the rib axes 824 of ribs 816, that is, and stated another way, about any longitudinal axis 826 that is generally parallel to spine axis 818. Again, the degree and extent of resistance to flexing or bowing that the segment of force direction structure 814 is capable of with respect to forces transverse to the rib axis 816 and parallel to the spine axis 818 will dependent upon such factors as the factors as the spacing, height, width, cross section and longitudinal sectional shapes and material of the ribs 816 and the flexibility and resilience of the spine 818, that is, and in the presently preferred embodiment, the flexibility and resilience of the inner sole 800 or mid-sole 802 material comprising the spine 818.

As a consequence, a "ribbon of ribs" formed by a force direction structure 814 is generally orthogonally bi-direction with regard to the resistance it offers to bending or flexing forces along the spine axis 820 and the rib axes 824. In addition, the amount or degree of the force required to bend or flex the structure and the resistance to bending or flexing of the structure along each axis, that is, the along spine axis 818 and the rib axes 824, will be dependent upon such factors as the factors as the spacing, height, width, longitudinal or cross sectional shapes and material of the ribs 816 and the flexibility and resilience of the spine 818. Other possible factors could include, for example, arching the top surface of rigs 816 or constructing ribs 816 as arches supported at each end on the spine 181 surface.

For example, higher, wider or thicker ribs 816 will increase the resistance to bending about axes parallel to the spine axis 820, that is, axes transverse to the rib axes 824, without correspondingly increasing the resistance to bending about axes transverse to spine axis 820, until the point where the ribs 816 come into contact with each other. It will be recognized different cross sections for the ribs 816 will yield similar results, with an "I-beam" cross section, for example, offering greater resistance than a tapered or rectangular cross section. In a like manner, the resistance to bending about axes transverse to spine axis 820, that is, axes parallel to the rib axes 824, may be increased by closer spacing of ribs 816, increased height or width of ribs 816, thereby possible causing the ribs 816 to come into progressive contact with one another, or a "stiffer" spine 818 material. Other possible factors could include, for example, arching the top surface of rigs 816 or constructing ribs 816 as arches supported at each end on the spine 181 surface.

As shown in FIGS. 58, 59, 60 and 63, in a presently preferred embodiment the force direction structure 814 is implemented in a "crossed ribbon loop" configuration that includes a heel loop segment 814L surrounding the heel of the foot. An inside transverse segment 814IT extends from the forward end of heel loop segment 814L on the inner side of the foot and crosses under the arch of the foot in approximately arch region 810 to curve into the curve of the outside of the foot at approximately the forward side of arch region 810. Lastly, an outside transverse segment 814OT extends from the forward end of heel loop segment 814L on the outer side of the foot and crosses under the arch of the foot in approximately arch region 810 to curve into the curve of the inner side of the foot at approximately the forward side of arch region 810.

As will be discussed further below, therefore, the behavior of each region of inner sole 800 and mid-sole 802 in dynamically directing and transferring the forces acting between the users foot, the inner and mid-soles, and the ground will be determined by the characteristics of the segment of force direction structure 814 residing in the region. For example, and as shown in FIGS. 58, 59 and 60, the ribs 816 of heel loop segment 814L are shaped to extend across a part of the lower outer circumference of the foot and to extend upwards by a selected distance around the circumference of the heel, and to extend in this manner up to arch region 810, at the forward side of heel region 804. The ribs 816 of heel loop segment 814L thereby assist in restraining sidewise and rotational movement of the user's heel during a stride.

It will also be noted that in the presently preferred embodiment illustrated in FIGS. 58, 59 and 60 one half of heel loop segment 814L and the inside transverse segment 814IT are located on mid-sole 802 and that the other half of heel loop segment 814L and the outside transverse loop segment 814OT are located on inner sole 800. In addition, in the illustrated embodiment the ribs 816 on inner sole 800 are on the lower surface of inner sole 800 and are comprised of the material of inner sole 800 while the ribs 816 on mid-sole 802 are on the upper surface of mid-sole and are comprised of the more rigid material comprising the ball/toe region 806 of mid-sole 802.

It is therefore apparent that the ribs 816 of outside transverse segment 814OT and inside transverse segment 814IT would mutually interfere in the region in which outside transverse segment 814OT and inside transverse segment 814IT cross. As a result one or both sets of ribs 816 must be modified for mutual accommodation. In the present embodiment, and considering that, as discussed above, the characteristics of a given region of the inner sole 800 and mid-sole 802 will be determined by the locally dominate segment of the force direction structure 814, the accommodation is selected to provide the desired result as regards the direction and transfer of forces during a stride. More specifically, and as discussed in greater detail below, in the presently preferred embodiment the ribs 816 of the inner transverse segment 814IT are effectively eliminated in the cross-over region under arch region 810, so that the characteristics of the outer transverse segment 814OT predominate in this region.

Therefore considering the operation of the exemplary force direction structure 814 during a stride of the right foot, wherein the paths of force or weight transfer are indicated by dashed arrows, the user's heel and the heel of the footwear will strike the ground at the start of the stride. At this point the ribs 816 of heel loop 814L will restrain the heel and lower part of the foot around the heel against sidewise and rotational motion.

In the next stage of the stride, the user weight is progressively transferred onto the arch region 810, where the user's arch is supported by the ribs 816 of outside transverse segment 814OT in the area of overlap between outside transverse segment 814OT and inside transverse segment 814IT.

In the continuation and concluding stage of the stride, the ribs 816 of outside transverse segment 814OT, which will flex about an axis transverse to the spine axis 820 of the outside transverse segment 814OT, will tend to direct a portion of the user's weight forward, towards the outer edge of the foot in the region of the ball of the foot and onto the outer toes. The characteristics of the inside transverse segment 814IT will, however, dominate in this stage of the stride and will flex about one or more axes transverse to the spine axis 820 of inside transverse segment 814IT, thereby directing the larger part of the user's weight and force from the outer edge of the foot in arch region 810 and towards the inner ball/toe region 806 of the foot.

While the above has described a presently preferred embodiment of the invention, it will be appreciated that the force direction structure 814 of the present invention may implemented in a number of other ways, depending upon the specific requirements of the user and the footwear. For example, the entire force direction structure 814 may be fabricated on one or the other of the inner sole 800 or the mid-sole 802, rather than a part on each, or the distribution of the segments of the force direction structure 814 between the inner sole 800 and the mid-sole 802 may be different from that illustrated. For example, the entire heel loop 814L may be constructed on one of the soles rather than divided between the two. In yet another alternative implementation, the force direction structure 814 may be implemented as a structure that is fabricated independently of the inner sole 800 and mid-sole 802 and that, for example, engages with the inner sole 800 and mid-sole 802 when assembled. This implementation would thereby facilitate the fabrication of a limited range of relatively standardized inner soles 800 and mid-soles 802 and the fabrication of force direction structures 814 that were tailored to specific purposes or to specific users.

In other instances, the force direction structure 814 may not be implemented as a crossed ribbon loop, but may instead be implemented as non-crossing loop with the open end towards the toes, with the desired force and weight direction characteristics being determined by the configuration of the ribs 816. In this regard, it must be noted that the weight and force direction characteristics of a force direction structure 814 are not dependent solely on the configuration of the force direction structure 814 as a whole but are dependent, for example, on such factors as the factors as the spacing, height, width, length, longitudinal or cross sectional shapes and material of the ribs and the flexibility and resilience of the spine structure or whether the top surfaces of the ribs are arched or the ribs themselves are constructed as arches.

As also noted, in the areas of a force direction structure 814 in which the transverse segments cross the characteristics of the force direction structure 814 are determined by the relative dominance of the ribs of the two crossing segments. In the above discussed implementation, for example, the ribs 816 of the inside transverse segment 814IT were effectively removed in the crossing area to allow the characteristics of the ribs 816 of the outside transverse segment 814OT to dominate in that region. In other implementations, for example, the heights of the ribs 816 of the crossing segments could both be reduced by some proportionality to determine a more complex characteristic structure in the crossing region, and so on.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of present invention which is to be given the full breadth of the claims appended and any and all equivalents thereof.

What is claimed is:

1. A footwear sole structure for dynamically directing interacting forces between a user's foot and the footwear during a stride of a user, the footwear sole structure comprising:

an inner sole for engagement with the user's foot, a mid-sole located between the inner sole and an outer sole, and a rib ribbon force transfer structure located between the inner sole and the mid-sole, wherein the rib ribbon force transfer structure comprises a plurality of ribs spaced along and transversely to a spine axis and attached to a longitudinally extending spine, whereby the plurality of ribs resists flexing about an axis parallel to the spine axis and allows a relatively greater degree of flexing about an axis transverse to the spine axis, the rib ribbon force transfer structure is located along a path between the inner and mid-soles to dynamically direct the interacting forces between the user's foot and the footwear as a user's weight shifts from a heel to a toe position during a stride, and a first portion of the rib ribbon force transfer structure is integral with a bottom surface of the inner sole while a second portion of the rib ribbon force transfer structure is integral with a top surface of the mid-sole.

2. The footwear sole structure of claim 1, wherein:

a first half of a heel loop segment and an inside transverse segment are located on an upper surface of the mid-sole and that a second half of a heel loop segment and an outside transverse loop segment are located on a lower surface of the inner sole.

3. The footwear sole structure of claim 1, wherein at least one region of a ball/toe region of the inner sole has an inner sole engagement structure while at least a ball/toe region of the mid-sole has a corresponding mid-sole engagement structure which engages with the inner sole engagement structure to prevent relative movement between the ball/toe region of the inner sole and the ball/toe region of the mid-sole.

4. The footwear sole structure of claim 1, wherein at least a heel and arch section of the mid-sole is fabricated from a relative hard and non-resilient material while the inner sole is fabricated from a relatively more resilient material than the heel and arch section of the mid-sole.

5. The footwear sole structure of claim 4, wherein a region of mid-sole forming a ball/toe region of the mid-sole is fabricated from a relatively non-resilient but flexible material than the heel and arch section of the mid-sole.

6. The footwear sole structure of claim 1, wherein the rib ribbon force transfer structure comprises a plurality of spaced apart ribs which each extend substantially parallel to one another.

7. The footwear sole structure of claim 1, wherein a first portion of the rib ribbon force transfer structure extends from a heel segment, along an inner side of the footwear sole, and the rib ribbon force transfer structure crosses an arch support region of the footwear and the rib ribbon force transfer structure terminates along an outer side of the footwear near the arch support region.

8. The footwear sole structure of claim 1, wherein a first portion of the rib ribbon force transfer structure extends from a heel segment, along an inner side of the footwear sole, and the rib ribbon force transfer structure crosses an arch support region of the footwear and the rib ribbon force transfer structure terminates along an outer side of the footwear near the arch support region, and a second portion of the rib ribbon force transfer structure extends from the heel segment, along an outer side of the footwear sole, and the second portion of the rib ribbon force transfer structure crosses the arch support region of the footwear, over the first portion of the rib ribbon force transfer structure, and terminates along an inner side of the footwear.

9. The footwear sole structure of claim 1, wherein the rib ribbon force transfer structure extends completely around a perimeter of the entire heel portion of the footwear sole for dynamically interacting with a heel of the user's foot.

10. The footwear sole structure of claim 1, wherein the plurality of spaced apart ribs, in the heel portion, generally extend from an outer perimeter of the footwear sole toward a central area of the heel portion.

11. A footwear sole structure for dynamically directing an interacting force between a user's foot and the footwear during a stride of a user, the footwear sole structure comprising:

an inner sole for located for engage with the user's foot;

a mid-sole located between the inner sole and an outer sole; and a rib ribbon force transfer structure located between the inner sole and the mid-sole, and the rib ribbon force transfer structure including:

a plurality of ribs spaced along and transversely to a spine axis and attached to a longitudinally extending spine, whereby the rib ribbon resists flexing about an axis parallel to the spine axis and allows a relatively greater degree of flexing about an axis transverse to the spine axis;

the rib ribbon force transfer structure being located along a path between the inner sole and the mid-sole for dynamically directing the interacting force between the user's foot and the footwear as weight of the user shifts from a heel to a toe position during a stride; and the rib ribbon force transfer structure is located between the inner and mid-soles along a crossed ribbon loop path and includes a heel loop segment surrounding a heel section of a foot, an inside transverse segment extending from the inner forward end of the heel loop segment on an inner side of the foot and crossing under an arch of the foot in approximately an arch region and curving into a curve of an outside of the foot at approximately a forward side of the arch region, and an outside transverse segment extending from the forward end of the heel loop segment on an outer side of the foot and crossing under the arch of the foot in approximately the arch region and curving into a curve of an inner side of the foot at approximately the forward side of the arch region, whereby a force direction characteristic of each region of the inner and mid-soles is determined by the flexing characteristics of the force direction structure located in the region.

12. The footwear sole structure of claim 11, wherein:

the ribs of a portion of the inner transverse segment are generally eliminated in the arch region where the outer transverse segment crosses the inner transverse segment so that the flexing characteristic of the outer transverse segment predominate in the arch region.

13. The footwear sole structure of claim 12, wherein: the heel loop segment restrains the heel of the user's foot against at least one of a transverse motion and a rotational motion, and the outer transverse segment in the region of the arch directs a transfer of the user's weight from the outer side of the foot and across the arch to the inner side of the foot at a ball and toe region of the foot.

14. The footwear sole structure of claim 11, wherein a first portion of the heel loop segment and the inside transverse segment are incorporated into the mid-sole and a second portion of the heel loop segment and the outside transverse loop segment are incorporated into the inner sole.

15. The footwear sole structure of claim 11, wherein a first portion of the heel loop segment and the inside transverse segment are located on an upper surface of the mid-sole and that a second portion of the heel loop segment and the outside transverse loop segment are located on a lower surface of the inner sole.

16. A footwear sole structure for dynamically directing an interacting force between a user's foot and footwear during a stride of a user, the footwear sole structure comprising:

an inner sole provided for engagement with the user's foot, an outer sole for engaging a contact surface;

a mid-sole located between the inner sole and the outer sole; and a rib ribbon force transfer structure located between the inner sole and the mid-sole;

wherein the rib ribbon force transfer structure comprises a plurality of spaced apart ribs which extend along and transversely of a spine axis and the plurality of spaced apart ribs resists flexing about an axis parallel to the spine axis and allow a relatively greater degree of flexing about an axis transverse to the spine axis;

the rib ribbon force transfer structure is located along a path for dynamically directing the interacting force between the user's foot and the footwear as a user's weight shifts from a heel position to a toe position during a stride; and a first end of the rib ribbon force transfer structure commences adjacent a heel segment and the rib ribbon force transfer structure extends primarily along an outer side of the footwear sole and crosses an arch support region of the footwear such that a second end of the rib ribbon force transfer structure terminates along an inner side of the footwear and is located remote from the outer side of the footwear sole and adjacent inner side of the footwear sole.

17. The footwear sole structure of claim 16, wherein the rib ribbon force transfer structure extends completely around a perimeter of the entire heel portion of the footwear sole for dynamically interacting with a heel of the user's foot.

18. The footwear sole structure of claim 16, wherein the plurality of spaced apart ribs, in the heel portion, generally extend from an outer perimeter of the footwear sole toward a central area of the heel portion.

19. The footwear sole structure of claim 16, wherein at least one region of a ball/toe region of the inner sole has an inner sole engagement structure while at least a ball/toe region of the mid-sole has a corresponding mid-sole engagement structure which engages with the inner sole engagement structure to prevent relative movement between the ball/toe region of the inner sole and the ball/toe region of the mid-sole.

20. The footwear sole structure of claim 16, wherein at least a heel and arch section of the mid-sole is fabricated from a relative hard and non-resilient material while the inner sole is fabricated from a relatively more resilient material than the heel and arch section of the mid-sole, and a region of mid-sole forming a ball/toe region of the mid-sole is fabricated from a relatively non-resilient but flexible material than the heel and arch section of the mid-sole.

* * * * *